US010405599B2

(12) United States Patent
Mercado, Jr. et al.

(10) Patent No.: US 10,405,599 B2
(45) Date of Patent: Sep. 10, 2019

(54) FORM-FITTING PROTECTIVE HEADGEAR WITH INTEGRATED FASTENING SYSTEM AND DETACHABLE EYE SHIELD

(71) Applicant: Falcon Helmet Design & Engineering, Inc., New York, NY (US)

(72) Inventors: Mario R. Mercado, Jr., New York, NY (US); Richard Walker, Miami Beach, FL (US)

(73) Assignee: Falcon Helmet Design & Engineering, Inc., New York, NY (US)

( * ) Notice: Subject to any disclaimer, the term of this patent is extended or adjusted under 35 U.S.C. 154(b) by 271 days.

(21) Appl. No.: 15/460,911

(22) Filed: Mar. 16, 2017

(65) Prior Publication Data

US 2017/0265557 A1 Sep. 21, 2017

Related U.S. Application Data

(60) Provisional application No. 62/309,333, filed on Mar. 16, 2016.

(51) Int. Cl.
*A42B 3/18* (2006.01)
*A42B 3/04* (2006.01)
(Continued)

(52) U.S. Cl.
CPC ..... *A42B 3/185* (2013.01); *A42B 3/00* (2013.01); *A42B 3/0406* (2013.01); *A42B 3/063* (2013.01);
(Continued)

(58) Field of Classification Search
CPC ..... A42B 3/185; A42B 3/00; A42B 3/0406; A42B 3/063; A42B 3/08; A42B 3/069; A42B 3/205; A42B 3/32; A63B 71/10
(Continued)

(56) References Cited

U.S. PATENT DOCUMENTS 1,887,636 A 11/1932 Hamby
3,028,602 A * 4/1962 Miller ..... A42B 3/14 2/183

(Continued)

FOREIGN PATENT DOCUMENTS

EP 2982257 A1 2/2016
WO WO-2018132777 A1 * 7/2018 ..... G02C 3/02

OTHER PUBLICATIONS

Written Opinion of the International Searching Authority issued in International Application No. PCT/US17/22754 dated Jun. 9, 2017.

*Primary Examiner* — Alissa L Hoey

(74) *Attorney, Agent, or Firm* — Bodner Law Group, PLLC; Christian P. Bodner; Gerald T. Bodner

(57) ABSTRACT

Provided is a protective headgear that includes a first shell section, second shell section, third shell section, and fourth shell section. The first shell section is configured to extend about a head of the user, and include a first central portion, a first strap and a second strap that extend from the first shell section. The first central portion includes a first protective layer and a second protective layer disposed atop the first protective layer. The second shell section is configured to extend about a jaw of the user, and include a second central portion, a third strap and a fourth strap that extend from the second shell section. The third shell section is connected to the first shell section by the first strap and the third strap, and the fourth shell section is connected to the second shell section by the second strap and the fourth strap.

18 Claims, 16 Drawing Sheets

(51) Int. Cl.

| | |
|---|---|
| ***A42B 3/06*** | (2006.01) |
| ***A42B 3/20*** | (2006.01) |
| ***A42B 3/24*** | (2006.01) |
| ***A42B 3/28*** | (2006.01) |
| ***A63B 71/10*** | (2006.01) |
| ***A42B 3/00*** | (2006.01) |

(52) U.S. Cl.
CPC ..... *A42B 3/069* (2013.01); *A42B 3/205* (2013.01); *A42B 3/24* (2013.01); *A42B 3/283* (2013.01); *A63B 71/10* (2013.01)

(58) Field of Classification Search
USPC ..... 2/424, 417
See application file for complete search history.

(56) References Cited

U.S. PATENT DOCUMENTS

| | | | | | |
|---|---|---|---|---|---|
| 3,934,271 | A | | 1/1976 | Rhee | |
| 3,984,875 | A | * | 10/1976 | Farquharson | A42B 3/08 2/10 |
| 4,279,037 | A | | 7/1981 | Morgan | |
| 4,551,861 | A | * | 11/1985 | Marchello | A63B 71/10 2/209 |
| 4,686,712 | A | * | 8/1987 | Spiva | A42B 3/185 2/10 |
| 4,689,836 | A | * | 9/1987 | Vitaloni | A42B 3/326 2/411 |
| 4,710,985 | A | | 12/1987 | Dubner et al. | |
| 5,012,533 | A | * | 5/1991 | Raffler | A42B 3/066 2/420 |
| 5,263,204 | A | * | 11/1993 | Butsch | A42B 3/326 2/424 |
| 5,361,420 | A | | 11/1994 | Dobbs et al. | |
| 5,448,780 | A | | 9/1995 | Gath | |
| 5,504,945 | A | * | 4/1996 | Purnell | A63B 71/10 2/209 |
| 5,522,091 | A | * | 6/1996 | Rudolf | A42B 3/069 2/414 |
| 5,572,749 | A | * | 11/1996 | Ogden | A42B 3/14 2/410 |
| 5,621,923 | A | * | 4/1997 | Tapocik | A42B 3/227 2/12 |
| 5,983,405 | A | * | 11/1999 | Casale | A42B 3/145 2/417 |
| 5,987,652 | A | * | 11/1999 | Fowler | A61F 9/027 2/424 |
| 6,381,760 | B1 | * | 5/2002 | Lampe | A42B 3/00 2/414 |
| 6,715,156 | B1 | | 4/2004 | Purnell | |
| 7,805,776 | B2 | * | 10/2010 | Crossman | A42B 3/044 2/410 |
| 8,510,870 | B2 | * | 8/2013 | Rogers | A42B 3/324 2/417 |
| 8,739,318 | B2 | * | 6/2014 | Durocher | A42B 3/125 2/417 |
| 9,021,616 | B2 | * | 5/2015 | Baty | A42B 3/14 2/416 |
| 9,480,293 | B2 | * | 11/2016 | Pfanner | A42B 3/085 |
| 9,743,701 | B2 | * | 8/2017 | Javorek | A42B 3/08 |
| 10,143,259 | B2 | * | 12/2018 | Liao | A42B 3/326 |
| 2001/0011388 | A1 | * | 8/2001 | Nelson | A42B 3/00 2/425 |
| 2002/0083512 | A1 | * | 7/2002 | Tsujino | A63B 71/10 2/423 |
| 2005/0034222 | A1 | * | 2/2005 | Durocher | A42B 3/12 2/425 |
| 2005/0120467 | A1 | * | 6/2005 | Desarmaux | A42B 3/16 2/422 |
| 2005/0183190 | A1 | * | 8/2005 | Hussey | A42B 3/185 2/424 |
| 2009/0044315 | A1 | | 2/2009 | Belanger et al. | |
| 2010/0095438 | A1 | * | 4/2010 | Moelker | A42B 3/145 2/418 |
| 2010/0154093 | A1 | * | 6/2010 | Provost | A42B 3/185 2/10 |
| 2011/0296595 | A1 | * | 12/2011 | Lukens | A63B 71/10 2/423 |
| 2014/0090153 | A1 | | 4/2014 | Siklosi et al. | |
| 2014/0331393 | A1 | | 11/2014 | DaSilva | |
| 2015/0150330 | A1 | | 6/2015 | Andrews et al. | |
| 2015/0157081 | A1 | | 6/2015 | Hyman | |
| 2017/0265556 | A1 | * | 9/2017 | Yang | A42B 3/128 |
| 2018/0325203 | A1 | * | 11/2018 | Cotterman | A42B 3/064 |
| 2018/0360155 | A1 | * | 12/2018 | Jenkyn | A42B 3/069 |

* cited by examiner

FORM-FITTING PROTECTIVE HEADGEAR WITH INTEGRATED FASTENING SYSTEM AND DETACHABLE EYE SHIELD

CROSS-REFERENCE TO RELATED APPLICATION

This application claims benefit of and priority to U.S. Provisional Patent Application No. 62/309,333 filed on Mar. 16, 2016, the contents of which are incorporated herein by reference in their entirety.

BACKGROUND

Field

The present application relates to headgear. More specifically, the present application is directed to a form-fitting protective headgear with an integrated fastening system and a detachable eye shield.

Brief Discussion of Related Art

Millions of people participate in various athletic activities and sports. In the United States, fifteen percent of all sports-related injuries are concussions, a type of head injury. Certain sports involve contact among participants (e.g., contact sports), such as football, ice-hockey, rugby, boxing, kickboxing, soccer, water polo, wrestling, as well as other contact sports. An estimated three million people worldwide, ages five to twenty-one and older, participate in amateur wrestling. Yet there are no mandated standards for wrestling headgear. Ear-guards are generally considered a form of headgear, but this term is a misnomer because ear-guards protect only the ears. While various ear-guards are available for use by wrestling participants, these ear-guards are designed to protect the outer ears but not to provide protection against head injuries, and as a result the ear-guards are ineffective in providing protection for the head, face, eyes, jaw, and brain of the participants. In regard to mandated standards, ear-guards are mandatory in high school and college programs and competitions in the United States, but ear-guards are optional in international competition.

Ear-guards are generally made from a molded plastic polymer, or vinyl coated energy absorbing foam, which is disposed over two rigid plastic liners. The ear-guards generally have a number of straps that extend between them in order for the participant to secure the ear-guards to the participant's head. For example, the ear-guards generally have several straps that extend behind the head, several straps that extend in the front-and-top of the head, and one strap that extends under the chin or on the chin. Moreover, the ear-guards are generally secured using hook-and-loop or button-snap mechanisms. Not only do ear-guards provide no protection against head injuries, but the straps also do not adequately secure the ear-guards to the head of the participant even when strapped tightly to the participant's head, and as such do not adequately prevent shifting or movement of the ear-guards during contact, which can lead to head-related injuries of the participant. More specifically, because the several straps are constantly pulled in various directions during contact, the ear-guards provide no protection against axial rotation of the head, which can stress significantly the neck muscles that support the participant's head.

Participants in wrestling, like other contact sports, have a higher risk of sustaining head injuries when compared to other non-contact sports due to levels of force coupled with types of impact that are prevalent in wrestling. In this regard, the rules of play in wrestling reward a participant in taking down an opponent from the standing position to the mat, and further, forcing the opponent to his/her back for several seconds. The foregoing can be accomplished by executing various techniques, most of which require significant force and acceleration. However, unlike other contact sports, such as football, ice-hockey, and several other sports, not all wrestling organizations mandate headgear, and further, equipment manufacturers have not produced headgear that would protect participants, particularly those participants at the youth and amateur levels, from sustaining various head injuries, such as head, face, eyes, jaw, and brain injuries.

It is therefore desirable to provide lightweight protective headgear, which can be easily disposed on a participant's head, fastened thereto, and removed therefrom, while providing a protective function that reduces the potential for head injuries.

SUMMARY

In accordance with an embodiment, a protective headgear is disclosed. The protective headwear includes a first shell section, a second shell section, a third shell section, and a fourth shell section.

The first shell section is configured to extend about a head of the user, and includes a first central portion, a first strap and a second strap that extend from the first shell section. The first central portion includes a first protective layer and a second protective layer disposed atop the first protective layer.

The second shell section is configured to extend about a jaw of the user, and includes a second central portion, a third strap and a fourth strap that extend from the second shell section.

The third shell section is connected to the first shell section by the first strap and the third strap, and the fourth shell section is connected to the second shell section by the second strap and the fourth strap.

The first central portion can include at least one opening through the first central portion.

The first protective layer can have a trapezoid shape. The trapezoid shape can have bowed top and bottom bases.

The second protective layer can have a bowtie shape, wherein the bowtie shape includes a first section, a second section, and a middle section that connects the first section and the second section. An opening through the second protective layer can be disposed along the middle section and can separate the first section and the second section.

The second protective layer can include two sections that are disposed atop the first protective layer. An opening through the second protective layer can separate the two sections disposed atop the first protective layer.

A strap of the first strap and the second strap can include two or more strap sections. The strap sections of the strap can have sloping walls that form a v-shaped recess between the strap sections. Moreover, at least one strap section can include an opening through the strap.

The headgear can further include a first lead, a second lead, a first connector, and a second connector. The first lead extends through a first channel in the first shell section, wherein the first lead has a first end and a second end. The second lead extends through a second channel in the second shell section, wherein the second lead has a third end and a fourth end.

The first connector is disposed atop the third shell section, wherein the first connector receives the first end and the third end. The second connector is disposed atop the fourth shell section, wherein the second connector receives the second end and the fourth end.

The headgear can further include a first coupler, and a second coupler. The first coupler can be disposed in the first connector, and can couple the first end and the third end. The second coupler can be disposed in the second connector, and can couple the second end and the fourth end.

The headgear can further include a tail section and a third lead. The tail section includes a lock. The third lead has a fifth end and sixth end. The third lead is connected to the lock, wherein the first connector additionally receives the fifth end, and the second connector additionally receives the sixth end. Moreover, the first coupler can additionally couple the fifth end, and the second coupler can additionally couple the sixth end.

The lock is configured to be rotated in a first direction that tensions the third lead, wherein the third lead in turn tensions the first lead and the second lead via the first coupler and the second coupler. Moreover, the lock is further configured to be rotated in a second direction that releases tension from the third lead, wherein the third lead in turn releases tension from the first lead and the second lead via the first coupler and the second coupler, respectively.

The headgear can further include an eye shield that has a first strap and a second strap. The connector can further include a first strap lock, wherein the first strap lock receives and secures the first strap. The second connector can further include a second strap lock, wherein the second strap lock receives and secures the second strap.

Moreover, the first strap can include a first set of sloped projections, and the second strap includes a second set of sloped projections. The first strap lock can include a third set of reciprocal sloped projections, wherein the third set of projections engages the first set of projections. Similarly, the second strap lock can include a fourth set of reciprocal sloped projections, wherein the fourth set of projections engages the second set of projections.

Additionally, the first strap lock can include a first opening configured to receive the first strap therein, and the second strap lock can include a second opening configured to receive the second strap therein.

These and other purposes, goals and advantages of the present application will become apparent from the following detailed description of example embodiments read in connection with the accompanying drawings.

BRIEF DESCRIPTION OF THE DRAWINGS

Some embodiments are illustrated by way of example and not limitation in the figures of the accompanying drawings in which.

DETAILED DESCRIPTION

A form-fitting protective headgear with an integrated fastening system and a detachable eye shield is disclosed herein. In the following description, for the purposes of explanation, numerous specific details are set forth in order to provide a thorough understanding of example embodiments. It will be evident, however, to one skilled in the art, that an example embodiment may be practiced without all of the disclosed specific details.

Figure 1:
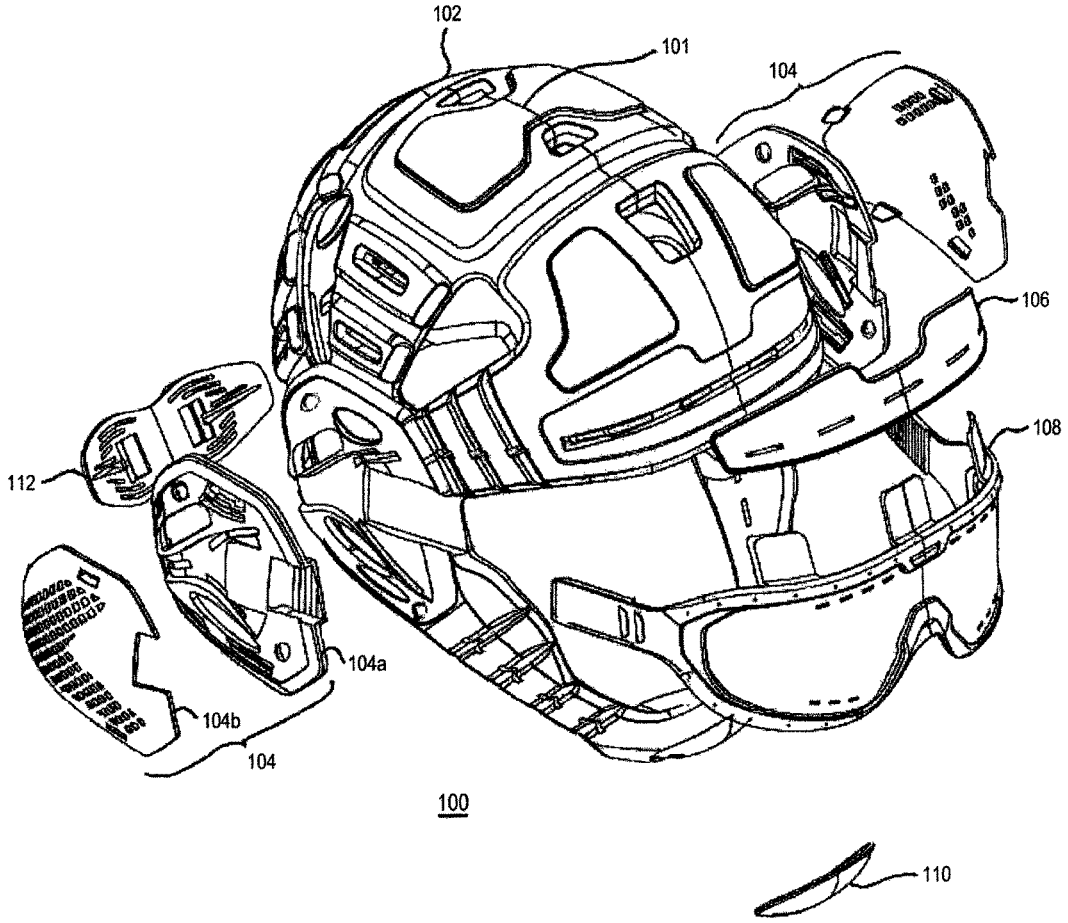
FIG. 1 illustrates an exploded perspective view of an example form-fitting protective headgear with an example integrated fastening system and an example detachable eye shield.

FIG. 1 illustrates an exploded perspective view an example form-fitting protective headgear 100 with an example integrated fastening system and an example detachable eye shield. The protective headgear 100 includes a flexible shell 102, connectors 104, forehead stabilizer 106, eye shield 108, chin guard 110, lock holder 112, leads (illustrated in FIGS. 9A-9C), and lock (illustrated in FIG. 10).

The protective headgear 100 is configured to provide a combination of protective functionality in an aesthetic, easy-to-use, and lightweight form-factor, which can reduce the potential for head injuries, such as head, face, eyes, jaw, and brain injuries. In some embodiments, the protective headwear 100 can be used with and without the eye shield 108. Moreover, in some embodiments the forehead stabilizer 106 can be omitted.

The flexible shell 102 is contoured to fit precisely and aesthetically about a participant's head and chin, as well as being configured to provide a protective function against head injuries resulting from various activities in which the participant engages. The flexible shell 102 is a monolithic, multilayer, dual-injection molded design that is lightweight and provides flexibility such that the protective headgear 100 can be easily disposed on a participant's head and removed therefrom. The flexible shell 102 is made in dual-injection mold from two halves, which are generally mirror images of one another about a centerline 101.

The flexible shell 102 is made of an elastomeric polymer, which enables the flexible shell 102 to be soft and flexible. The elastomeric polymer can be, for example, ethylene vinyl acetate (EVA), which is also known as polyethylene-vinyl acetate (PEVA). Other materials can be used include rubber, PVC, HDPE (high density polyethylene), and silicone, as well as various combinations thereof. The construction of the flexible shell 102 is described in greater detail hereinbelow in view of FIGS. 2A-2E.

The connector 104 is a central junction that facilitates the connection of several leads—e.g., forehead, jaw, and tail leads—for the tightening and releasing (e.g., simultaneous and/or contemporaneous tightening and releasing of the several leads) of the fastening system associated with the protective headgear 100. While the left and right connectors shown on opposite sides of the flexible shell 102 are labeled with the same reference number, it should nonetheless be understood that these connectors 104 are mirror images of one another. However, in different embodiments the connectors 104 of the opposite sides of the flexible shell 102 can also be different, as may be desired. For example, the left and the right connectors 104 can be different in order to allow for the correction of a head deformity, or one or more other reasons.

The connector 104 can be made of plastic or a thermoplastic that is light-weight yet exhibits high impact resistance and mechanical toughness. For example, the thermoplastic can be acrylonitrile butadiene styrene (ABS), polycarbonate, polyether-ether-ketone (PEEK), polyetherimide, polyethylene, polypropylene, polystyrene, polyvinyl chloride (PVC), polytetrafluoroethylene (PTFE) (e.g., Teflon), one or more other materials, as well as combinations of materials.

The connector 104 includes a connector base 104*a* and a connector cover 104*b*. The connector base 104*a* mates with a similarly-shaped recess of the flexible shell 102. While the connector base 104*a* can be glued to the recess of the flexible shell 102 using an adhesive, the connector cover 104*b* includes a combination of several tabs and projections such that the connector cover 104*b* can snap-lock with the connector base 104*a*. In various embodiments, the connector base 104*a* can alternatively, or in addition, be riveted to the flexible shell 102. The constructions of the connector base 104*a* and the connector cover 104*b* of the connector 104 are described in greater detail hereinbelow in view of FIGS. 3A-3C and 4A-4C, respectively.

The forehead stabilizer 106 provides stabilization to a forehead part of the frontal portion of the flexible shell 102, such that eye shield 108 can be retained in connection with the flexible shell 102. The forehead stabilizer 106 mates with and is glued to a similarly-shaped recess of the flexible shell 102.

Moreover, the forehead stabilizer 106 includes a channel that facilitates the passage of the forehead lead in connection with (e.g., over) the forehead part of the flexible shell 102. The forehead stabilizer 106 can be made of a plastic or thermoplastic that is light-weight yet exhibits high impact resistance and mechanical toughness. For example, the forehead stabilizer 106 is made of the same material as the connector 104 described hereinabove. The construction of the forehead stabilizer 106 is described in greater detail hereinbelow in view of FIGS. 5A-5C.

The eye shield 108 is configured to provide durable and distortion-free optical clarity through an entire range of vision. In addition, the eye shield 108 provides venting apertures or openings to reduce fogging, and can be coated with anti-fog coating to resist fogging.

The eye shield 108 is configured to contour to the participant's facial structure from a generally planar configuration to curvilinear structure, easily attaching to and detaching from the connectors 104 of protective headgear 100 via locking straps, to ensure clear peripheral vision of the participant at all angles. In this regard, the eye shield 108 is injection molded from a clear plastic, such as a polycarbonate that provides a flexible, impact-resistant, and shatter-proof form factor.

In view of the foregoing, the eye shield 108 can easily guard the eyes against various intentional and/or unintentional occurrences, such as using fingers to pinch, gouge, or scratch, as well as striking using the hands, fists, elbows, feet, knees, and/or the head. The construction of the eye shield 108 is described in greater detail hereinbelow in view of FIGS. 6A-6C.

The chin guard 110 is configured to protect the chin from damage caused by contact, such as for example contact with a participant and/or the mat. The chin guard 110 generally has curvilinear shell-shaped structure. The chin guard 110 can be made of a plastic or thermoplastic that is light-weight yet exhibits high impact resistance and mechanical toughness. The chin guard 110 mates with a similarly-shaped recess of the flexible shell 102. The chin guard 110 can be glued to the recess of the flexible shell 102. Moreover, the chin guard 110 includes a channel that facilitates the passage of the jaw lead in connection with (e.g., over) the chin part of the flexible shell 102.

The chin guard 110 can be made of plastic or a thermoplastic that is light-weight yet exhibits high impact resistance and mechanical toughness. For example, the chin guard 110 can be made of the same material as the connector 104, which was described hereinabove. The construction of the chin guard 110 is described in greater detail hereinbelow in view of FIGS. 7A-7C.

The lock holder 112 is configured to connect with and retain the lock in relation to the protective headgear 100. Moreover, the lock holder 112 is further configured to receive a tail lead from the connectors 104, and further to facilitate the passage of the tail lead through lock holder 112 such that they can connect with the lock. The lock holder 112 generally has as a bow-tie shape and mates with a similarly-shaped recess of the flexible shell 102. The lock holder 112 can be glued to the recess of the flexible shell 102. In various embodiments, the lock holder 112 can alternatively, or in addition, be riveted to the flexible shell 102.

The leads include the forehead, jaw, and rear leads that integrate and unify the fastening system associated with the protective headgear 100. The leads can be made as a monolithic lead (e.g., one lead), or can be connected or joined together, such as by fusing, gluing, tying, and/or using a connector (e.g., y-connector illustrated in FIG. 9C). Moreover, the leads are configured to be non-stretchable and capable of withstanding a substantial amount of tension, e.g., 300 lbs.-400 lbs. The ability to resist stretching mitigates damage to the flexible shell 102 as well as to other components of the protective headgear 100.

The leads can be wires, cables, ropes, and/or strings. The leads can be metal, plastic, or a combination thereof, such as plastic-coated or jacketed metal. The metal can be solid, stranded, braded and/or plaited. The rope or string can be natural or synthetic, such as nylon, polypropylene, polyester high modulus polyethylene (HMPE), aramid, and/or combinations thereof. The leads are described in greater detail hereinbelow in view of FIGS. 9A-9C.

The lock is configured to be received into and secured by the lock holder 112. The lock is further configured to connect and lock the tail lead from the connectors 104. Moreover, the lock is also configured to shorten and lock the tail lead in a predetermined amount by rotating in a first direction (e.g., clockwise), such that the forehead and jaw leads can be shortened—each shortened approximately evenly by half of the rear-lead amount—in order to tighten the integrated fastening system.

Similarly, the lock is also configured with a quick-release by rotating in a second direction (e.g., counterclockwise), which releases the tail lead—in order to release the forehead and jaw leads—allowing the participant to easily take off the protective headgear 100 from the participant's head. The lock provides improved performance, precision, comfort, durability, as well as fast and convenient operation. The lock is described in greater detail hereinbelow in view of FIG. 10.

The activities for which the protective headgear 100 will find implementation can include, for example, wrestling, rollerblading, biking, hiking, skateboarding, touch football, soccer, field hockey, girls lacrosse, water polo, rock climbing, skiing, and snowboarding, as well as other sports and/or activities. The foregoing list of sports and activities is not exhaustive, and people engaged in other sports and/or other activities that are not enumerated can benefit from the protective function in an aesthetic form-factor provided by the protective headgear 100. For example, the headgear 100 can find application in activities such as piloting remote aircraft (e.g., drones).

FIGS. 2A-2E illustrate an example flexible shell 102 of the protective headgear 100 illustrated in FIG. 1.

The flexible shell 102 is contoured such that it fits precisely and aesthetically about a participant's head and chin, and is further configured to provide a protective function against head injuries resulting from various activities in which the participant engages. In these regards, the flexible shell 102 provides a form-factor that is lightweight and flexible such that the protective headgear 100 can be easily disposed on a participant's head and removed therefrom through opening 201.

The flexible shell 102 is configured to at least partially cover the head of the participant, including the frontal, parietal, temporal, occipital, and cerebellum brain portions of the participant's head, as well as the jaw of the participant, including the chin portion. The construction of the flexible shell 102 includes several shell sections 202, 222, 244, 262, 282, and 290, which are generally associated with the aforementioned portions of the head and the jaw. More specifically, the frontal shell section 202, the parietal shell section 222, the occipital shell section 244, the cerebellum shell section 262, and the temporal shell section 282 are generally associated respectively with the frontal, the parietal, the occipital, the cerebellum, and the temporal brain portions of the participant's head. In addition, the jaw shell section 290 is generally associated with the jaw portion of the participant's head. For clarity and brevity of the description, the several sections 202, 222, 244, 262, 282, and 290 will hereinafter be simply referred to simply as shell sections.

The shell sections 202, 222, 244, and 290 extend radially from the left temporal shell section 282 in a curvilinear or arcuate direction to the right temporal shell section 282, which are generally central to the foregoing shell sections and facilitate the formation of the flexible shell 102. The shell sections 202, 222, and 244 are configured to extend about or around the head, and the shell section 290 is configured to extend about or around the jaw. While the left and the right temporal shell sections 282 shown on opposite sides of the flexible shell 102 (FIG. 2B) are labeled with the same reference number, it should nonetheless be understood that these shell sections 282 are mirror images of one another. However, in different embodiments the temporal shell sections 282 of the opposite sides of the flexible shell 102 can also be different, as may be desired. For example, the left and the right temporal shell sections 282 can be different in order to allow for the correction of a head deformity, or one or more other reasons.

The cerebellum shell section 262 is configured to extend in a curvilinear or arcuate direction down from the occipital shell section 244. More specifically, the shell section 262 is configured to extend down the back of the head and toward the neck.

The flexible shell 102 has a structure that is generally monolithic and multilayered, and which is lightweight and provides flexibility such that the protective headgear 100 can be easily disposed on the participant's head. More specifically, the shell sections 202, 222, 244, 262, 282 and 290 are disposed in relationship to one another to create an expandable opening 201. The expandable opening 201 allows the flexible shell to be easily disposed on a participant's head and removed therefrom through the opening 201, such that shell sections 202, 222, 244, and 262 are disposed atop and about the head, left and right shell sections 282 are disposed atop and about the ears, while shell section 290 is disposed atop and about the jaw. When the flexible shell 102 is disposed atop the participant's head, the face of the participant is disposed in the opening 203 that is formed between the shell section sections 202 and 290.

The flexible shell 102 generally includes a three-layered structure, which includes a first base layer, a second middle layer, and a third top layer. The base layer is generally illustrated as layer 200. The structure of the layers, as well as the number of the layers, can vary among the shell sections, as will be described in greater detail hereinbelow. Moreover, the flexible shell 102 is not limited to the three-layered structure and the structure of the flexible shell 102 can thus include more or fewer layers.

The frontal shell section 202 includes the base layer 200, a middle layer 204, a top layer 206, a recess 208, a ventilation opening 209, and flexible straps (flex-straps) 216 on opposite sides of the flexible shell 102. The shell section 202 is generally defined by the middle layer 204 disposed atop the first base layer 200.

The middle layer 204 is defined by a center section 205, and left and right tapering edge sections 207. More specifically, the tapering edge sections 207 extend from the center section 205 toward the opposite sides of the flexible shell 102 and taper into the flex-straps 216, which connect the frontal shell section 202 to the temporal shell sections 282 on opposite sides of the flexible shell 102.

The top layer 206 includes sections 206*a*, 206*b*, which are disposed along the center section 205 of the middle layer 204, and which are separated by the ventilation opening 209. More specifically, the sections 206*a*, 206*b* are generally disposed in locations of forehead bossing, which are sections of the forehead (e.g., protrusions of the forehead) that are located over the brow of the participant's eyes. The sections 206*a*, 206*b* are generally irregular trapezoidal shapes, and extend along the middle layer between flex-straps 216. The sections 206*a*, 206*b* have bottom portions (bases) that extend in the direction of the flex-straps 216, and provide a contour that tapers toward the tapering of the edge sections 207 of the center section 205. Various different shapes of the sections 206*a*, 206*b* can of course be provided, such as rectangles, circulars, squares, other geometric shapes, as well as combinations of the geometric shapes.

The recess 208 extends arcuately or curvilinearly across the middle layer 204 between the flex-straps 216, and is configured to receive forehead stabilizer 106. A plurality of slots 215 are provided along the interior of the base layer 200 of the frontal shell section 202, which are configured to receive tabs of eye shield 108, such that the eye shield 108 can be secured along the forehead in relation to the flexible shell 102.

The ventilation opening 209 is configured to provide for elimination of heat produced by the participant. The opening 209 is of a generally trapezoidal shape, which is inverted in relation to the irregular trapezoidal shapes of sections 206*a*, 206*b* of the top layer 206. Various different shapes of the opening 209 can of course be provided such as rectangles, circulars, squares, other geometric shapes, as well as combinations of the geometric shapes.

Each of the flex-straps 216 includes strap sections 218, 220, and 221. The strap sections 218, 220, and 221 are generally rectangular (or trapezoidal) and graduated, tapering along the flex-straps 216 toward the temporal shell sections 282 on the opposite sides of the flexible shell 102. One or more walls of the strap sections 218, 220, and 221 slope downward toward the base layer 200, forming v-shaped recesses 219. The recesses 219 generally extend to approximate the level of base layer 200. Moreover, a similar v-shaped section is provided between section 207 of the center section 205 and the strap sections 218 of the flex-straps 216 on the opposite sides of the flexible shell 102. This construction of the flex-straps 216 provides for and improves the flexibility of the flexible shell 102, while still retaining the substantial protective function.

The frontal shell section 202 includes a first channel 210 that extends arcuately or curvilinearly along the frontal shell section 202 between the temporal shell sections 282 on opposite sides of the flexible shell 102. For clarity of the description, the first channel will sometimes hereinafter be designated as the forehead channel. The first (forehead) channel 210 includes a trench 212 along the middle layer 204, and plurality of openings 214 along the flex-straps 216. While the channel 210 receives the forehead lead that extends the along the channel 210 of the shell section 202 between and to the left and right temporal shell sections 282, the trench 212 receives tubular sections of the forehead stabilizer 106.

The parietal shell section 222 includes the base layer 200, a middle layer 224, 240, a top layer 226, ventilation openings 228*a*, 228*b*, and flexible straps (flex-straps) 230 on opposite sides of the flexible shell 102. The shell section 222 is generally defined by the middle layer 224 disposed atop the first base layer 200.

The middle layer 224 generally has a rectangular (or trapezoidal) shape, the sides of which taper from the front to the back of the flexible shell 102, contouring to the participant's head. The bases of the trapezoidal shape bow outwardly approximately in the center and taper toward the temporal shell sections 282, in order to contour to the participant's head. Various different shapes of the middle layer 224 can of course be provided, such as rectangles, circulars, squares, other geometric shapes, as well as combinations of the geometric shapes. The middle layer 224 further includes ventilation openings 228*a*, 228*b*.

The middle layers 224, 240 are disposed at a distance from one another. Similarly, the middle layer 240 generally has a rectangular (or trapezoidal) shape, the sides of which taper from the front to the back of the flexible shell 102, contouring to the participant's head. The bases of the trapezoidal shape bow outwardly approximately in the center and taper toward the temporal shell sections 282, in order to contour to the participant's head. Various different shapes of the middle layer 240 can of course be provided, such as rectangles, circulars, squares, other geometric shapes, as well as combinations of the geometric shapes. The middle layer 240 similarly includes a ventilation opening 242.

Moreover, the base layer 200 of the middle layer 224 extends from the middle layer 224 toward the opposite sides of the flexible shell 102, and tapers into the flex-straps 230, which connect the shell section 202 to the temporal shell sections 282.

The top layer 226 is disposed generally along the center of the middle layer 224. Further, the top layer 226 generally has a bowtie shape, and extends along the middle layer 224 between flex-straps 230. The bowtie shape has wide side portions connected by a narrow middle portion. The ventilation openings 228*a*, 228*b* are disposed along the narrow middle portion of the bowtie, thereby separating the wide side portions.

The flex-straps 230 connect the shell section 222 to the temporal shell sections 282. Moreover, each of the flex-straps 230 includes strap sections 232, 236. The strap sections 232, 236 are generally rectangular (or trapezoidal) and graduated, tapering along the flex-straps 230 toward the temporal shell sections 282 on the sides of the flexible shell 102. The strap section 232 is disposed at a distance from strap section 236. This construction of the flex-straps 230 provides for and improves the flexibility of the flexible shell 102, while still retaining the substantial protection function. Moreover, the strap sections 232, 236 include respective ventilation openings 234, 238.

The occipital shell section 244 includes the base layer 200, a middle layer 246, a top layer 248, ventilation openings 250*a*, 250*b*, and flexible straps (flex-straps) 252. The shell section 244 is generally defined by the middle layer 246 disposed atop the first base layer 200.

The middle layer 246 generally has a rectangular (or trapezoidal) shape, the sides of which taper from the front to the back of the flexible shell 102, contouring to the participant's head. The top base of the trapezoidal shape bows outwardly approximately in the center and tapers toward the temporal shell sections 282, while the bottom base extends approximately straight toward the temporal shell sections 282, in order to contour to the participant's head. Various different shapes of the middle layer 246 can of course be provided, such as rectangles, circulars, squares, other geometric shapes, as well as combinations of the geometric shapes. Similar to other middle layers, the middle layer 246 includes ventilation openings 250*a*, 250*b*.

The flex-straps 252 connect the shell section 244 to the temporal shell sections 282. Moreover, each of the flex-straps 252 includes strap sections 254, 258. The strap sections 254, 258 are generally rectangular (or trapezoidal) and graduated, tapering along the flex-straps 252 toward the temporal shell sections 282 on the sides of the flexible shell 102. This construction of the flex-straps 252 provides for and improves the flexibility of the flexible shell 102, while still retaining the substantial protection function. Moreover, the strap sections 254, 258 include respective ventilation openings 256, 260.

Figure 8A:
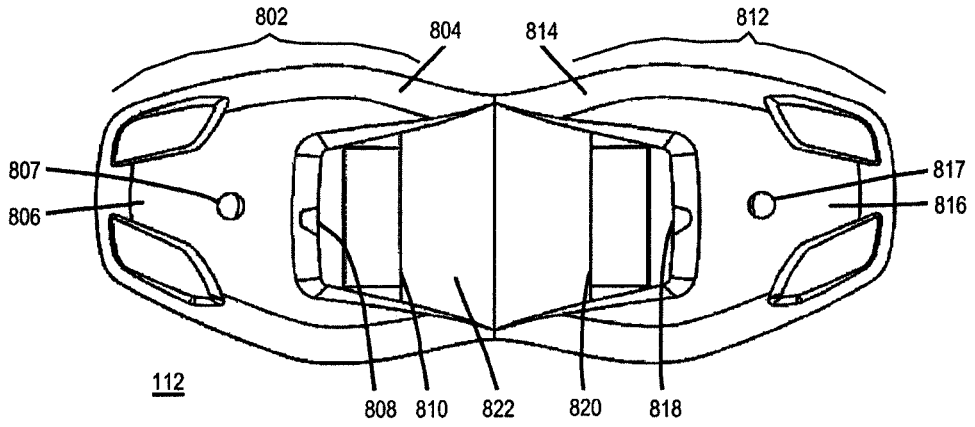
FIGS. 8A-8C illustrate an example lock holder of the fastening system associated with the protective headgear illustrated in FIG. 1.
Figure 8B:
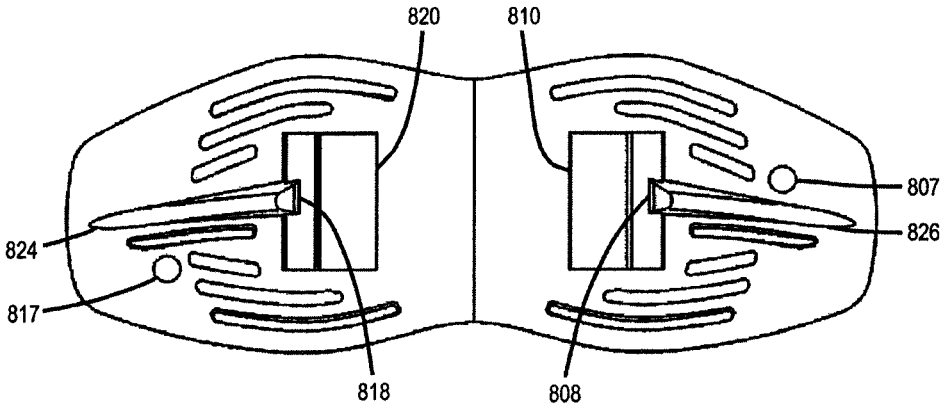
Figure 8C:
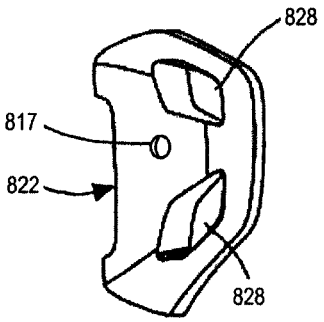

The cerebellum shell section 262 includes the base layer 200 that extends to a flexible strap (flex-strap) 272, which is configured to extend in a curvilinear or arcuate direction down the back of the head and toward the neck. The flex-strap 272 includes strap sections 264, 268, 273. More specifically, the strap sections 264, 268 are generally rectangular (or trapezoidal) and graduated, tapering along the flex-straps 272 toward the neck of the participant. Moreover, the strap sections 264, 268 include respective ventilation openings 266, 270. The strap section 273 is a tail section that has left and right portions, which extend about the head/neck arcuately or curvilinearly toward the temporal shell sections 282 on the sides of the flexible shell 102. The tail section 273 includes walls 274, 276 that define a recess 278. The recess 278 receives the lock holder (FIGS. 8A-8C). The walls 274, 276 of the recess 278 bow inwardly toward the recess 278 and provide a height so that lock holder can be cradled in the recess 278 of the tail section 273. The channels 280 extend outwardly toward the temporal shell sections 282 on the sides of the flexible shell 102. These channels 280 will guide the tail lead extending from the temporal shell sections 282 to the lock holder that can be cradled in the tail section 273. This construction of the flex-strap 272 provides for and improves the flexibility of the flexible shell 102, while still retaining the substantial protective function.

While not shown in detail, the interior surface of the tail section 273 can be smooth or textured (e.g., grooves, peaks-and-valleys, etc.). Texturing can provide better gripping of the participant's neck.

The temporal shell section 282 is central section that connects to the flex-straps 216, 230, 252, and 290 (described below), and further facilitates the receipt of the connector 104 and the several leads—e.g., forehead, jaw, and tail leads—for the tightening and releasing of the fastening system associated with the protective headgear 100. While the left temporal shell section 282 is shown, it should be understood that a right temporal shell section 282 is on the opposite side of the flexible shell 102. As described herein, the left and right shell sections 282 are mirror images of one another. However, in different embodiments the shell sections 282 of the opposite sides of the flexible shell 102 can also be different, as may be desired (e.g., deformity correction).

The shell section 282 includes a y-shaped recess 283, guides 284, 285, 288, ventilation openings 286, recess 281, and rivet openings 287. The y-shaped recess 283 includes guides 284, 285 that connect to the respective channels 210, 211 (described below) of the shell sections 202, 290, and guide 288 extends toward guide 280 of the tail section 272. Moreover, the guides 284, 285 have respective openings from the channels 210, 211. It should be noted that the guides 284, 285, and 288 facilitate the receipt of the several leads, e.g., forehead, jaw, and tail leads, and further facilitate communication of the leads to the connector 104.

The ventilation openings 286 are configured to provide for elimination of heat produced by the participant. The recess 281 facilitates receipt of an eye-shield lock of the connector base 104*a* and a strap of eye shield 108, such that the strap of the eye shield 108 can be disposed inside the connector 104, as will be described in greater detail herein. In embodiments that use rivets to secure the several connectors 104 to the flexible shell 102, the rivet openings 287 can be provided to receive respective rivets. In those embodiments that do not use rivets, the rivet openings 287 can of course be omitted.

Ventilation openings 239, 241, and 271 are provided among sections 202, 222, and 282, sections 222, 244, and 282, and sections 244, 262, and 282, respectively.

The jaw shell section 290 includes flexible straps (flex-straps) 292, which extend along the jaw to chin and the central chin section 296 to the left and right sections 282 of the flexible shell 102. The flex-straps 292 can have varying widths, such as being wider about the cheek areas (providing protective function to the cheeks), and tapering to narrower sections along the jaw to the chin section 296. The flex-straps 292 include multiple sections, which can be of varying width as described above, such as sections 293, 294. The strap sections 293, 294 are generally rectangular (or trapezoidal) and can be graduated or tapering toward the chin section 296 of the flexible shell 102.

While not shown in detail, the interior surface of the chin section 296 can be smooth or textured (e.g., grooves, peaks-and-valleys, etc.). Texturing can provide better gripping of the participant's chin.

One or more walls of the strap sections 293, 294 slope downward, forming v-shaped recesses 295. The recesses 295 generally extend to approximate the level of base layer 200. This construction of the flex-strap 292 provides for and improves the flexibility of the flexible shell 102, while still retaining the substantial protective function. The chin section 296 includes recess 298, which is configured to receive the chin guard 110.

The jaw shell section 290 includes a second channel 211 that extends arcuately or curvilinearly along the jaw shell section 290 between the temporal shell sections 282. For clarity of the description, the second channel 211 will sometimes hereinafter be designated as the jaw channel. The first (jaw) channel 211 includes a plurality of openings 297 along the flex-straps 292, such as that the jaw channel 211 can receive the jaw lead that extends the along the channel 211 of the shell section 290 between and to the left and right temporal shell sections 282.

Figure 2A:
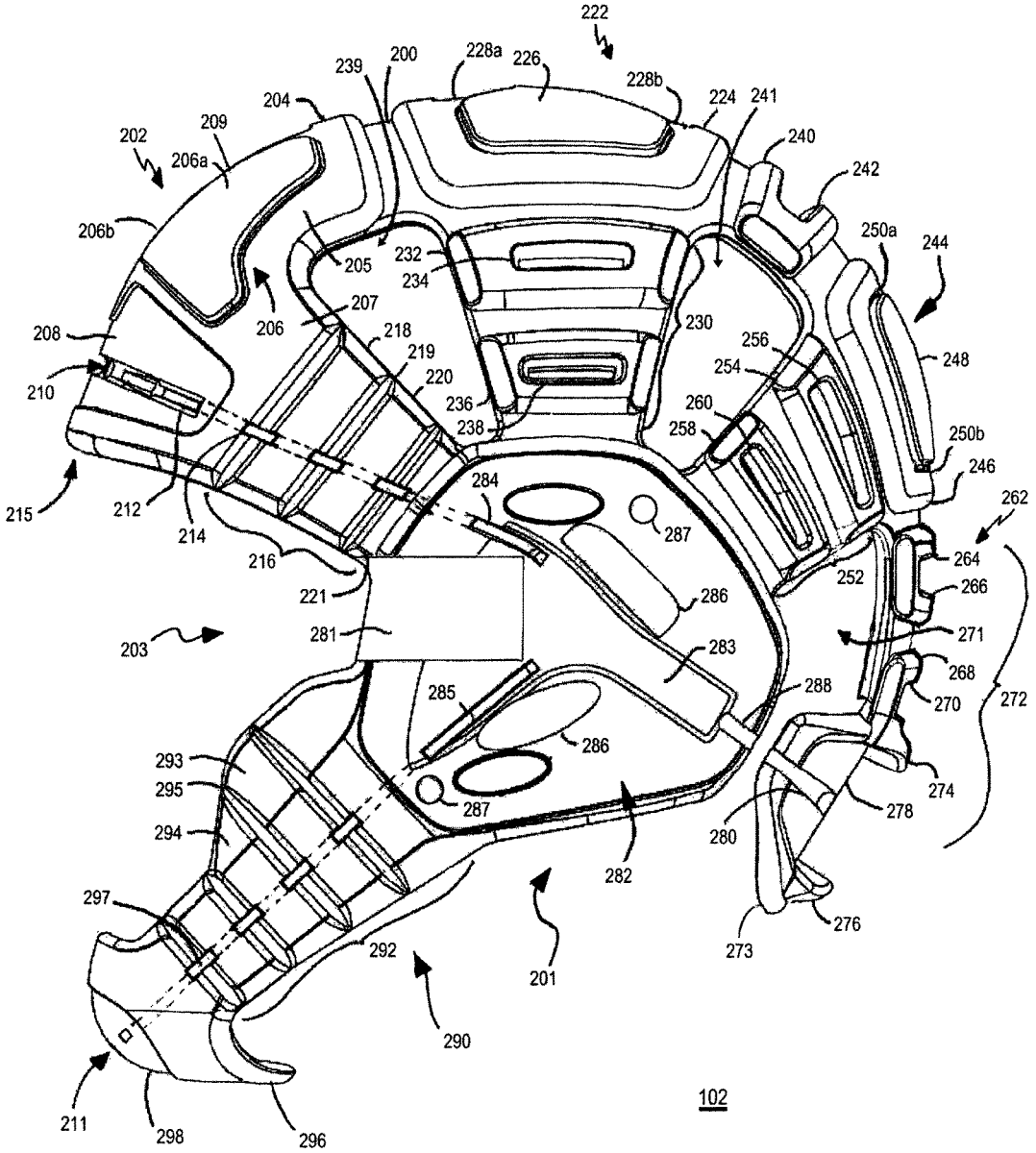
FIGS. 2A-2E illustrate an example flexible shell of the protective headgear illustrated in FIG. 1.
Figure 2B:
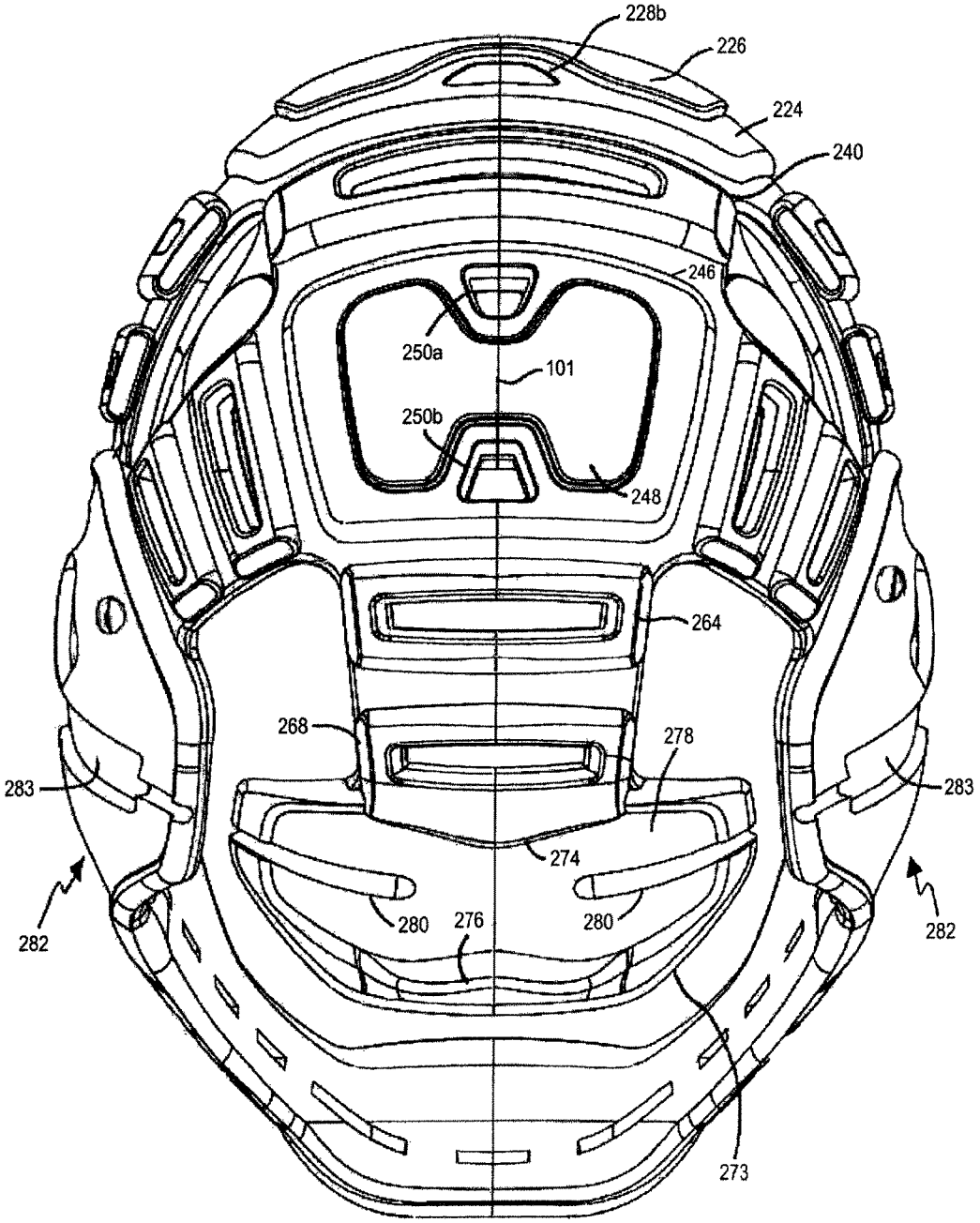
Figure 2C:
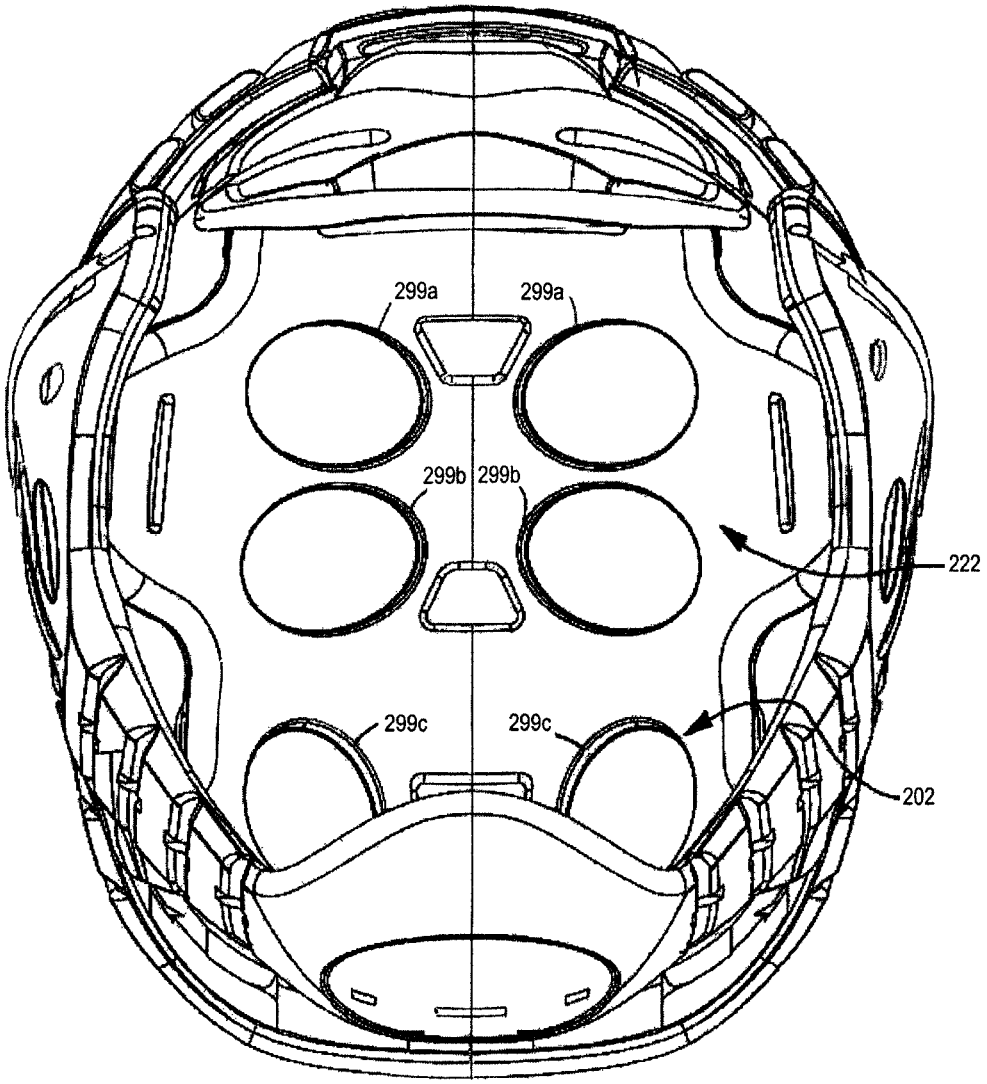
Figure 2D:
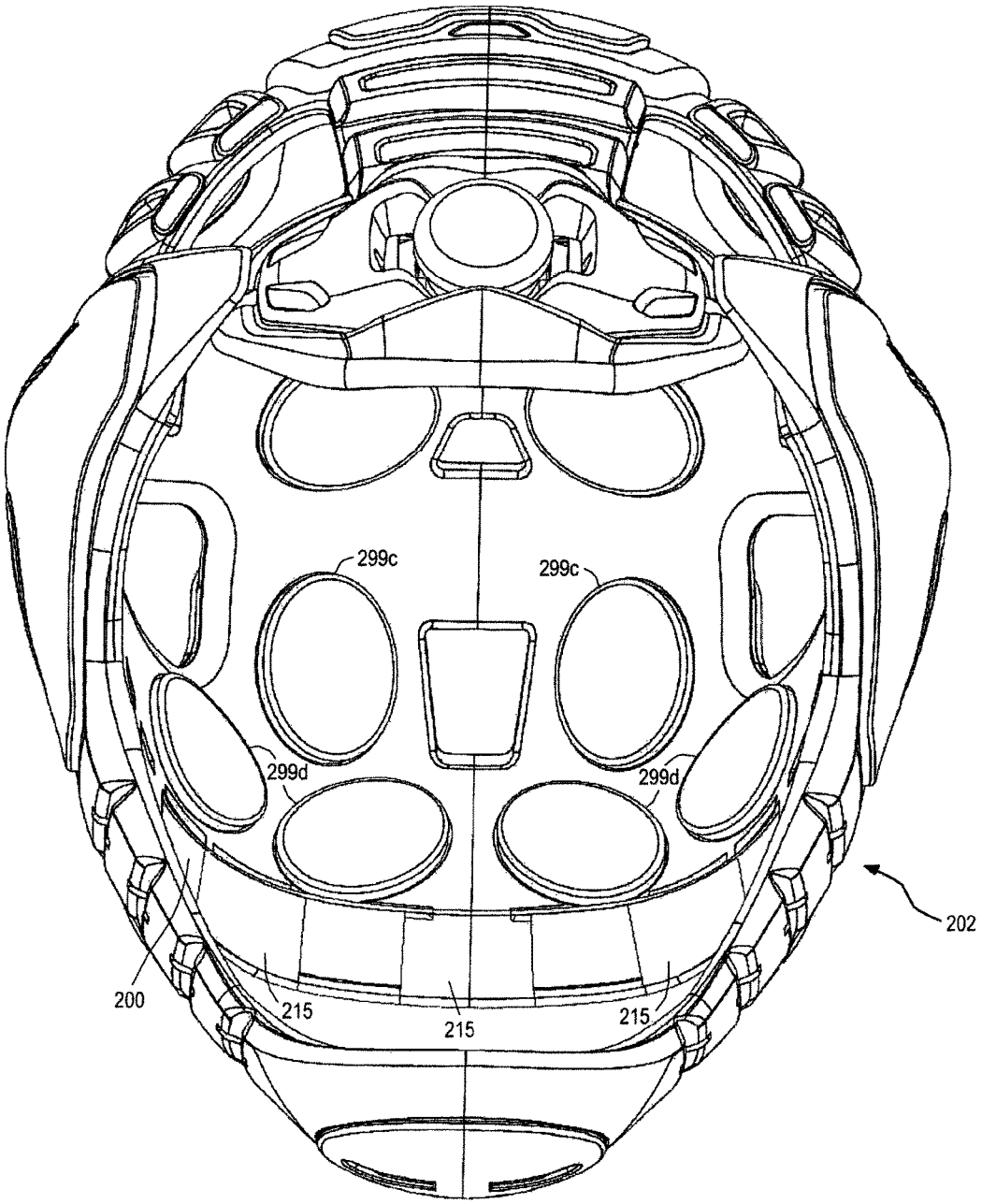
Figure 2E:
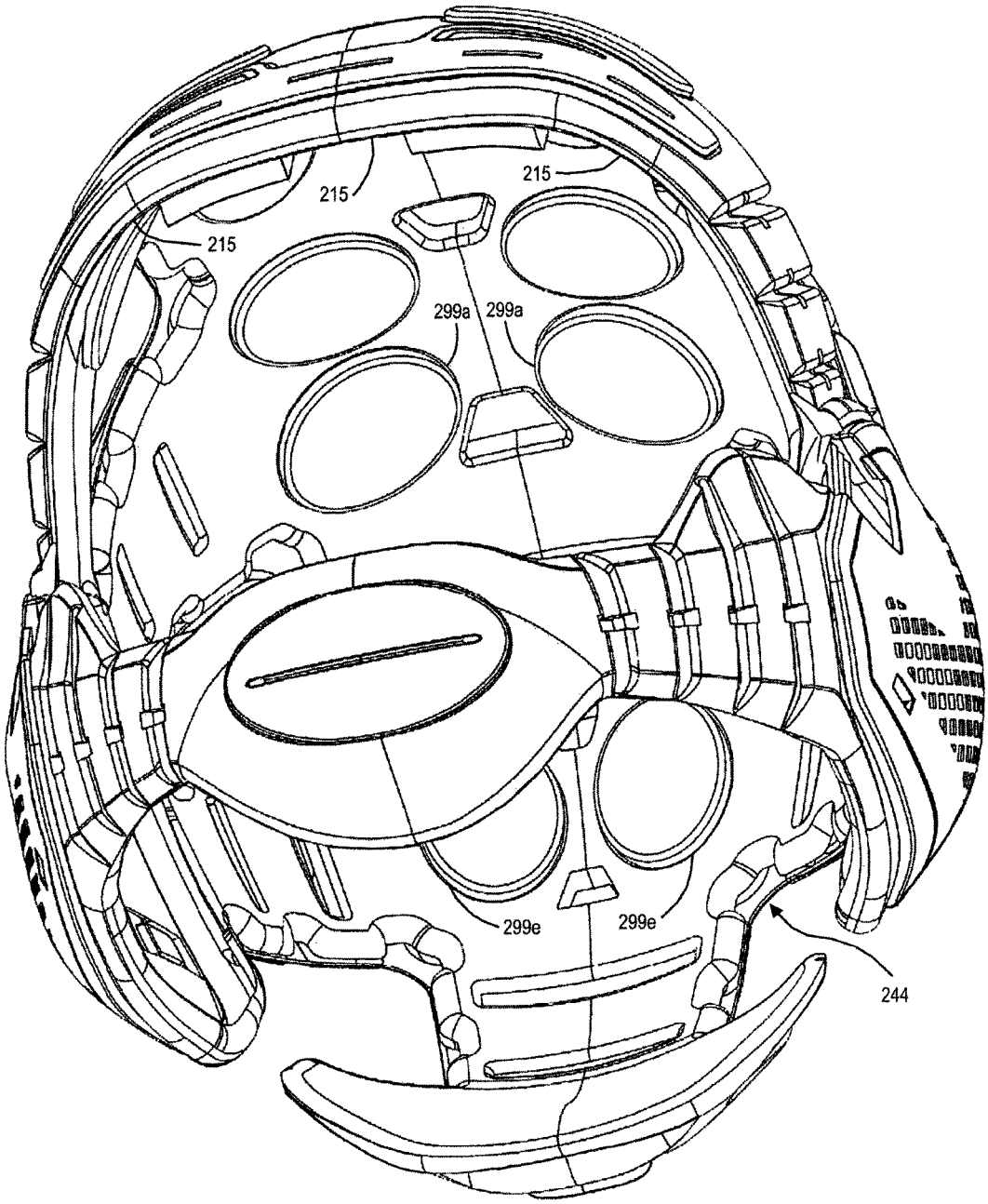

As illustrated in FIGS. 2C-2E, the flexible shell 102 includes a plurality of recesses on the interior of the flexible shell 102 along the sections 202, 222, and 244, which can receive impact-absorbing pieces 299*a*-299*e*. For example, section 202 can receive pieces 299*c*, 299*d*, section 222 can receive pieces 299*a*, 299*c*, and section 244 can receive pieces 299*e*. The pieces 299*a*-299*e* are positioned so as to cover substantial portions of the undersurface of the sections 202, 222, and 244, which could provide absorption and dissipation of sudden impacts to the top of the flexible shell 102.

The pieces 299*a*-299*e* can be glued into the recesses of the flexible shell using an adhesive. Alternatively or additionally, the pieces 299*a*-299*e* can be formed as part of the dual injection molding of the flexible shell 102. In some embodiments, the pieces 299*a*-299*e* can have an oval shape. The pieces can be made of viscoelastic foam (e.g., memory foam), which can absorb sudden impacts to the flexible shell 102, allowing slowed compression and dissipation of the impacts. The height pieces 299*a*-299*e* can facilitate ventilation of heat produced by the participant under the flexible shell, such that the heat can be dissipated and eliminated through openings of the flexible shell, such as openings 209, 228*a*, 228*b*, 234, 238, 239, 241, 242, 250*a*, 250*b*, 256, 260, 266, and 270.

Various different shapes of the pieces 299*a*-299*e* can of course be provided, such as rectangles, circulars, squares, other geometric shapes, as well as combinations of the geometric shapes.

As further illustrated in FIGS. 2C-2E, the flexible shell 102 includes a plurality of slots 215 along the interior of the base layer 200 of the frontal shell section 202. The slots 215 are configured to receive the tabs of eye shield 108, such that the eye shield 108 can be secured along the forehead in relation to the flexible shell 102, as stabilized by the forehead stabilizer 106, for example.

Figure 3A:
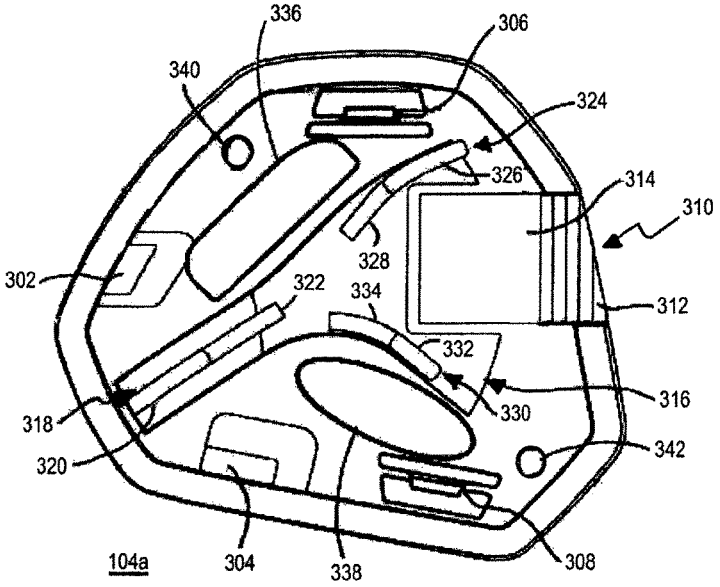
FIGS. 3A-3C illustrate an example base of a connector of the fastening system associated with the protective headgear illustrated in FIG. 1.
Figure 3B:
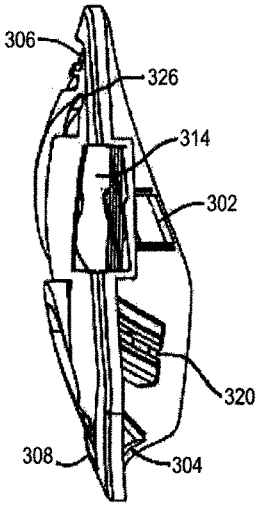
Figure 3C:
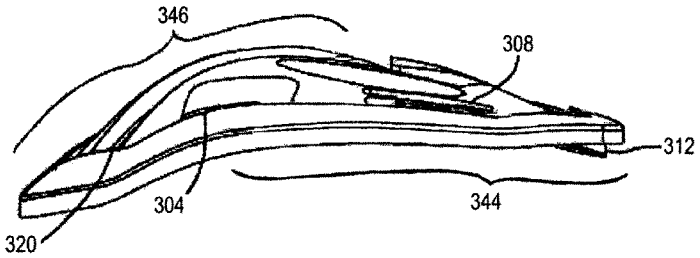

FIGS. 3A-3C illustrate an example connector base 104*a* of the connector 104 of the fastening system associated with the protective headgear 100, illustrated in FIG. 1.

As described hereinabove, the connector base 104*a* mates with a recess of the flexible shell 102. More specifically, the connector base 104*a* can be glued and/or riveted to the recess of the temporal shell section 282 of the flexible shell 102. In this regard, the connector base 104*a* is shaped similarly to the temporal shell section 282 of the flexible shell 102 to facilitate a smooth mating or connection among the connector base 104*a* and the temporal shell section 282. While the right connector base 104*a* is illustrated in FIGS. 3A-3C, it should nonetheless be understood that left connector base 104*a* is a mirror image. However, in different embodiments the connector base 104*a* can also be different based on the shape of temporal shell section 282 of the flexible shell 102, as may be desired for the certain corrections (e.g., head deformity), or one or more other reasons.

The connector base 104*a* includes slots 302, 304, snap-lock tabs 306, 308, an eye shield lock 310, y-shaped connection recess 316, ventilation openings 336, 338, and rivet openings 340, 342.

The slots 302, 304 are formed in the connector base 104*a* and receive tabs of the connector cover 104*b*. Similarly, the snap-lock tabs 306, 308 are formed in the connector base 104*a* and engage snap-lock projections of the connector cover 104*b*. In this manner, the connector cover 104*b* can be disposed easily in relation to the connector base 104*a* using slots 302, 304, and further snap-locked in relation to the connector base 104*a* using snap-lock tabs 306, 308.

The eye shield lock 310 includes staggered projections 312 and an opening 314. The projections 312 are angled or sloped (e.g., toward slot 302) so that the straps of the eye shield can be received into the opening 314, and reciprocal projections of the straps can be engaged and locked in the eye shield lock 310.

Figure 9A:
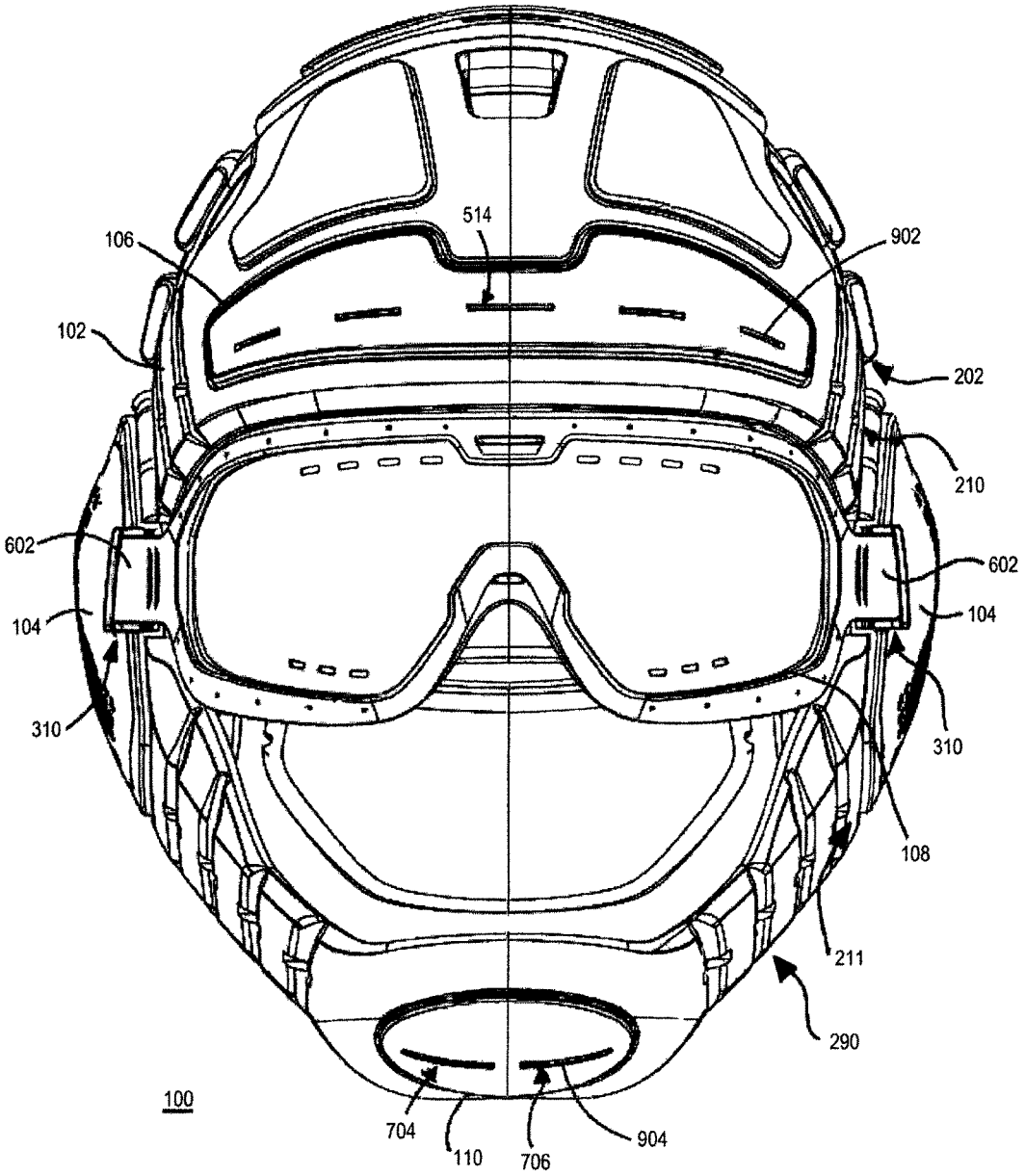
FIGS. 9A-9C illustrate several views of the assembled form-fitting protective headgear with the integrated fastening system and the detachable eye shield as illustrated in FIG. 1.
Figure 9B:
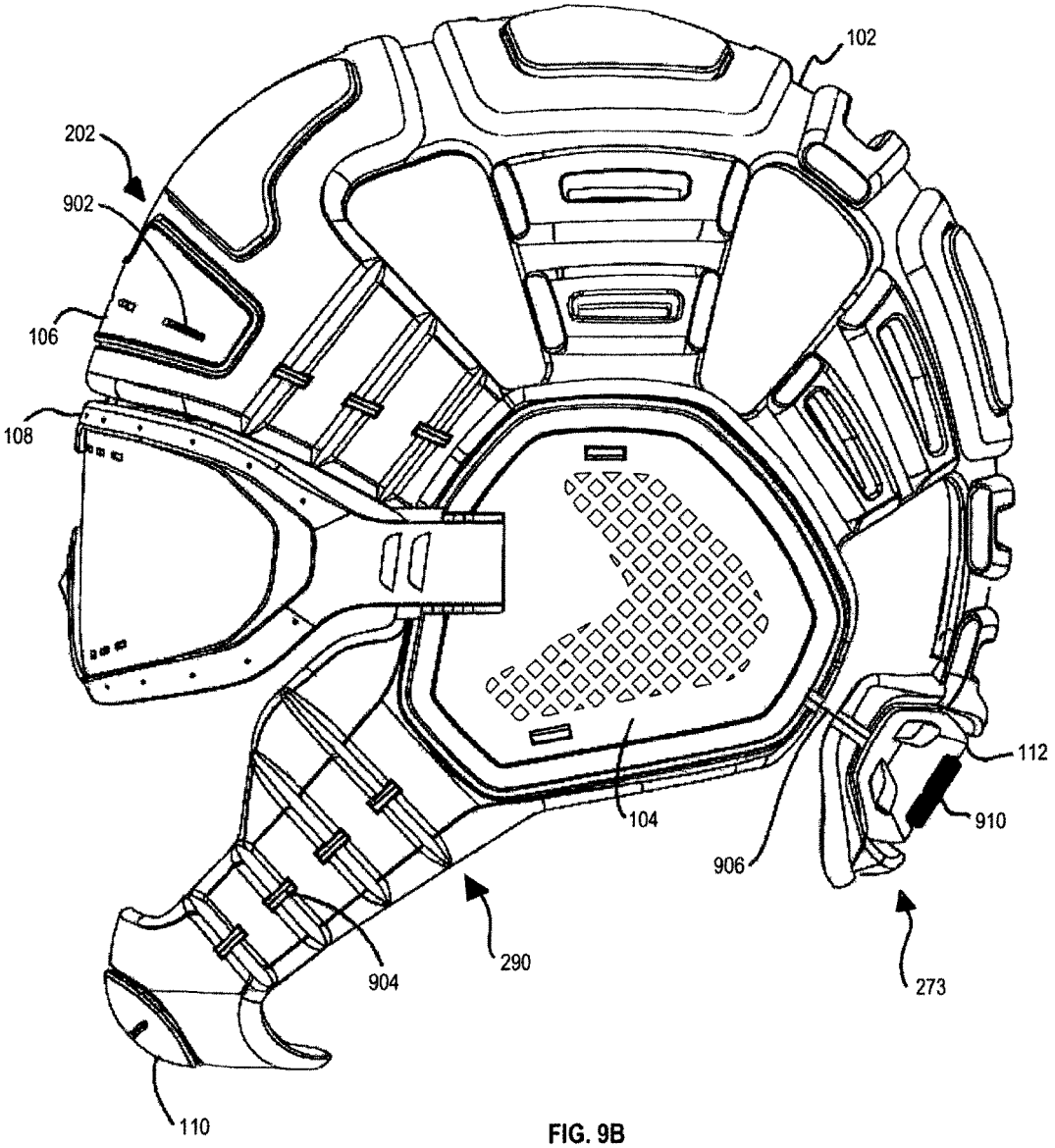
Figure 9C:
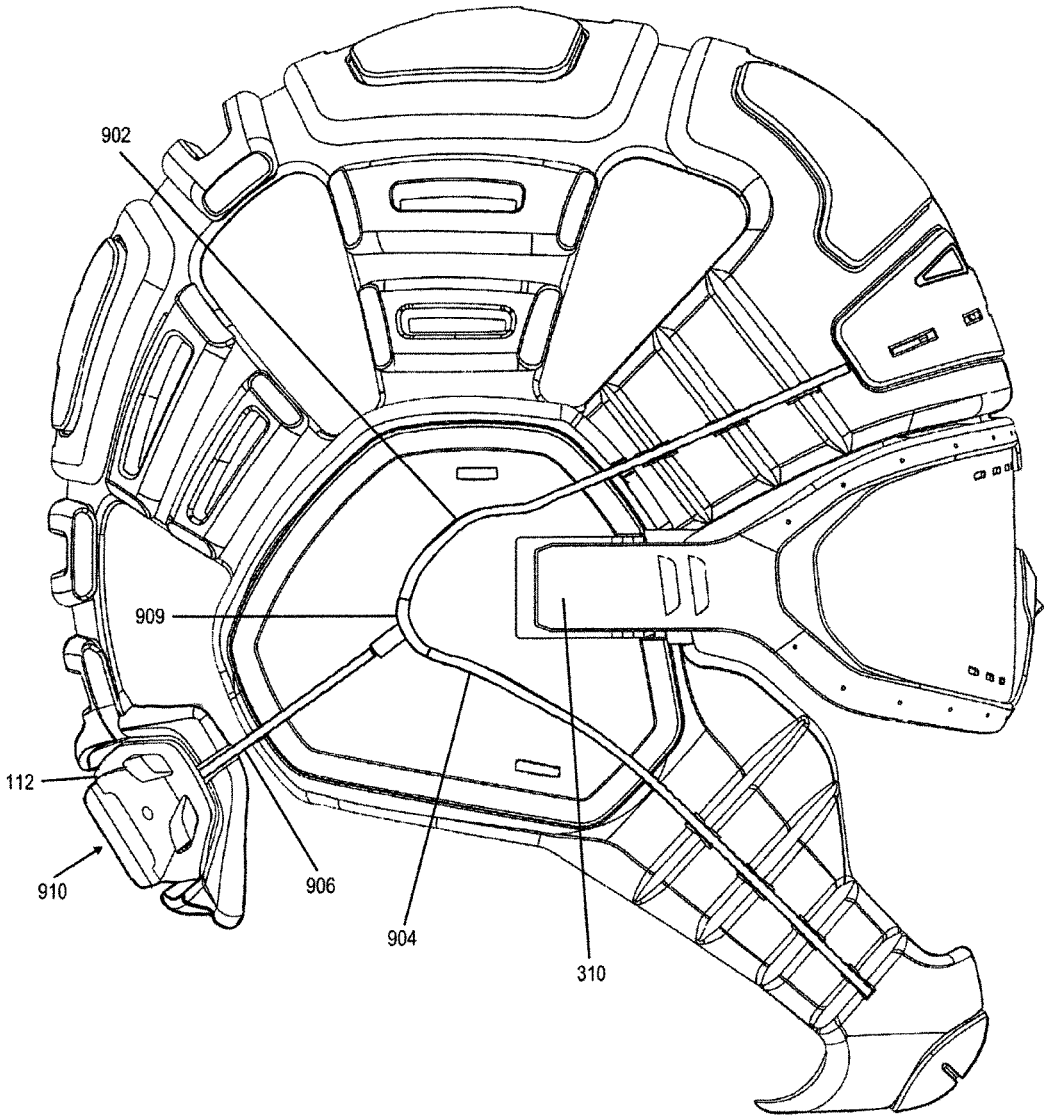

The y-shaped connection recess 316 is configured as a junction that facilitates the receipt of the forehead, jaw, and tail leads, and the connection of the aforementioned leads, such as via a y-connector (FIG. 9C). As described hereinbefore, the leads can be made as a monolithic lead (e.g., one lead), or can be connected or joined together, such as by fusing, gluing, tying, and/or using a connector (e.g., y-connector illustrated in FIG. 9C). Moreover, the recess 316 facilitates the containment and smooth operation of the leads in tightening and releasing the fastening system of the protective headgear 100. In this regard, the y-shaped connection recess 316 includes guide sections 318, 324, and 330.

The guide sections 318, 324, and 330 include respective combinations of openings and guides. More specifically, guide section 318 includes an opening 320 and a guide 322, guide section 324 includes an opening 326 and a guide 328, and guide section 330 includes an opening 332 and a guide 334. The guide sections 318, 324, and 330 facilitate the guidance of the leads during operation of the fastening system of the protective headgear 100.

The ventilation openings 336, 338 generally overlap similarly-shaped ventilation openings 286, 286 in the temporal shell section 282 of the flexible shell 102.

The rivet openings 340, 342 allow rivets to be extended through the openings 340, 342 and overlapping openings 287 in the temporal shell section 282 of the flexible shell 102, so that rivets can be used to secure the connector base 104*a* to the flexible shell 102.

Sections 344 and 346 are used to illustrate the contour of the connector base 104*a* in connection with the temple and ears of the participant. More specifically, section 344 is generally a flat section that contours the participant's temple, while section 346 is generally a raised section that is arcuate or curvilinear to contour the participant's ear. Section 344 transitions smoothly to section 346.

Figure 4A:
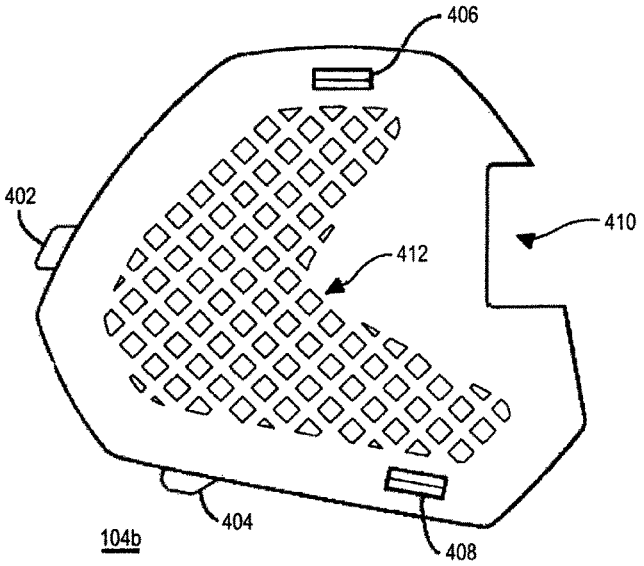
FIGS. 4A-4C illustrate an example cover of the connector of the fastening system associated with the protective headgear illustrated in FIG. 1.
Figure 4B:
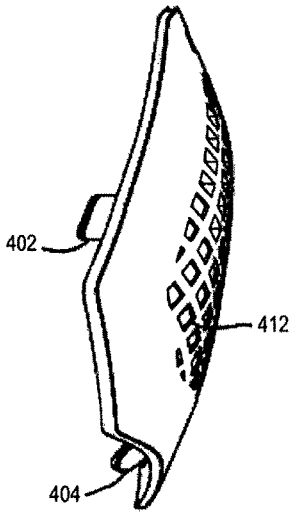
Figure 4C:
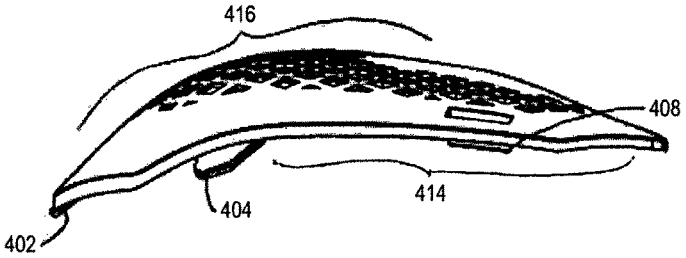

FIGS. 4A-4C illustrate an example connector cover 104*b* of the connector 104 of the fastening system associated with the protective headgear 100 illustrated in FIG. 1.

The connector cover 104*b* includes tabs 402, 404, snap-lock projections 406, 408, a recess 410, and one or more ventilation openings 412.

The tabs 402, 404 extend generally outwardly from the periphery of the connector cover 104*b*, and the snap-lock projections 406, 408 (e.g., L-shaped projections) extend generally downwardly from the connector cover 104*b*. While the tabs 402, 404 are received in a sliding fashion into the reciprocal slots 302, 304 of the connector base 104*a*, the projections 406, 408 deflect and then engage the reciprocal snap-lock tabs 306, 308 of the connector base 104*a*.

As described hereinabove, the connector cover 104*b* can be disposed easily in relation to the connector base 104*a*, and further snap-locked in relation to the connector base 104*a*. Moreover, the snap-lock projections 406, 408 are releaseably secured (e.g., L-shape includes arm and locking extension that are at an angle to one another), which allows the snap-lock projections 406, 408 to be released from the engagement with the snap-lock tabs 306. In this fashion, the connector cover 104*b* effectively covers the junction and connection of the forehead, jaw, and tail leads via the connector base 104*a*, while allowing access to the junction if and when necessary.

The recess 410 of connector cover 104*b* overlaps partially the opening 314 of the connector base 104*a*. This facilitates receipt of eye shield straps into the opening 314 and retention of the straps in the opening 314, once the projections of the straps engage the projections 312 of the eye shield lock 310.

The one or more ventilation openings 412 are disposed over the ventilation openings 336, 338 of the connector base 104*a*. This allows ventilation and dissipation of heat from the participant to the outside of the headgear 100.

Sections 414 and 416 are used to illustrate the contour of the connector cover 104*b* in connection with the temple and ears of the participant. These section are generally similar to the contours of section 344, 346, where section 344 is generally a flat section that contours the participant's temple, while section 346 is generally a raised section that is arcuate or curvilinear to contour the participant's ear. Section 414 transitions smoothly to section 416.

Figure 5A:
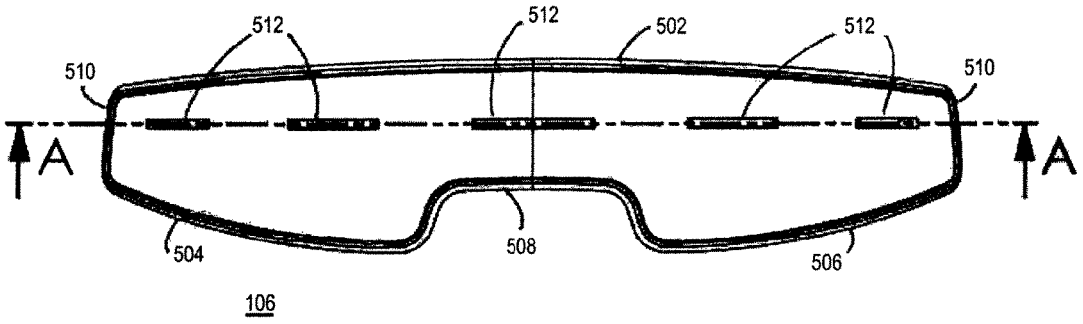
FIGS. 5A-5C illustrate an example stabilizer of the fastening system associated with the protective headgear illustrated in FIG. 1.
Figure 5B:
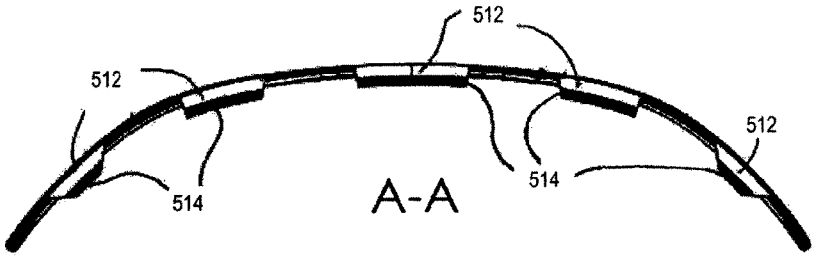
Figure 5C:
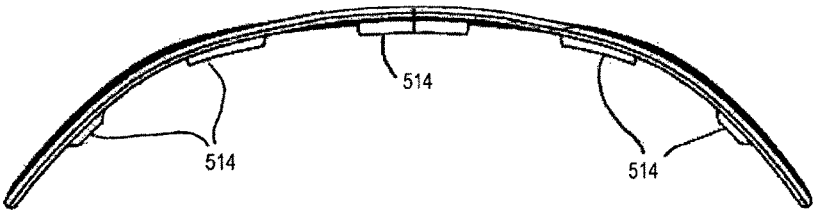

FIGS. 5A-5C illustrate an example stabilizer 106 of the fastening system associated with the protective headgear illustrated in FIG. 1.

The stabilizer 106 includes a top edge 502, bottom edges 504, 506, recessed edge 508, side edges 510, 510, an openings 512, and channel sections 514. The stabilizer 106 has a generally arcuate or curvilinear cross-section A-A, so that the stabilizer 106 can be disposed in the recess 208 of the flexible shell 102.

The top edge 502 has a bowed contour and extends along the frontal shell section 202 of flexible shell 102 between flex-straps 216. The bottom edges 504, 506 are separated by a recessed edge 508 and are arcuate or curvilinear extending toward the side edges 510, 510, contouring the tapering edge sections 207 of shell section 202. The recessed edge 508 is generally linear and engages a similarly-shaped projection of the recess 208, so that stabilizer 106 can be disposed and/retained precisely in the recess 208.

The channel sections 514 have openings 512. The channel sections 514 are configured to be disposed in reciprocal trench sections in the trench 212 of the recess 208 in the shell section 202 of flexible shell 102. The channel sections 514 cooperate with the channel 210 in order to allow the forehead lead to advance or extend about the frontal shell 202, between and to the shell section 282.

Figure 6A:
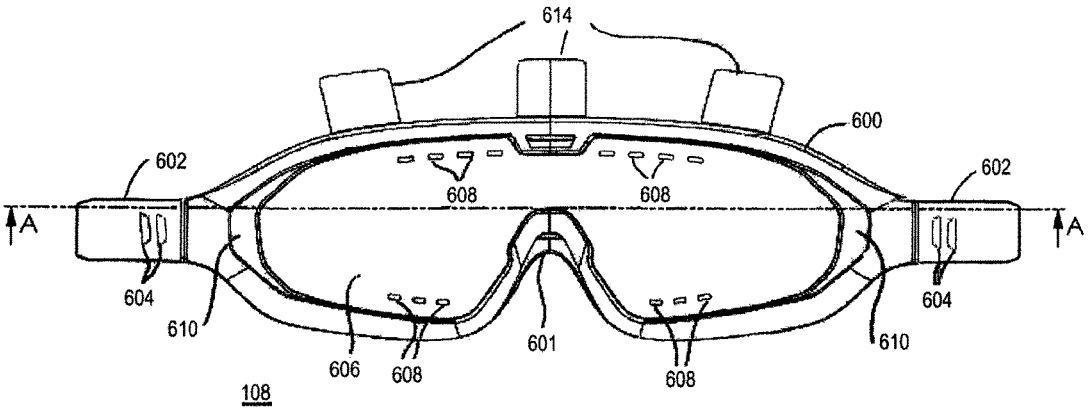
FIGS. 6A-6C illustrate an example detachable eye shield of the protective headgear illustrated in FIG. 1.
Figure 6B:
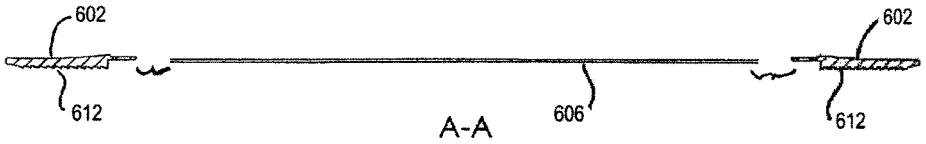
Figure 6C:
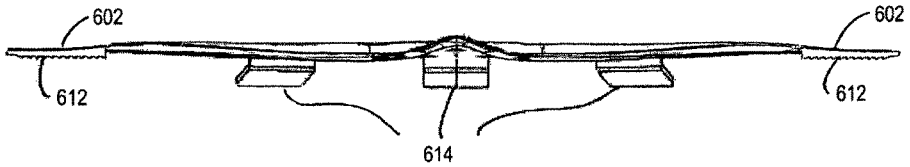

FIGS. 6A-6C illustrate an example detachable eye shield 108 of the protective headgear 100 illustrated in FIG. 1.

The eye shield 108 includes a frame 600, straps 602, lens 606, and ventilation slits 608, ventilation openings 610, projections 612, and tabs 614.

The frame 600 is configured to contour to the participant's facial structure from a generally planar configuration to curvilinear structure, easily attaching to and detaching from the connector 104 of protective headgear 100.

The straps 602 are configured to be received into the opening 314 of the eye shield lock 310. The straps include slits 604 and staggered projections 612. The slits 604 enables the participant to pull the straps 602 in order to engage and release the straps in relation to the eye shield lock 310. Specifically, the staggered projections 612 are angled or sloped (e.g., toward frame 606) so that the straps 602 of the eye shield 108 can engage and release from the engagement projections 312 of the lock 310, pulling or pushing the straps 602 by using the slits 604.

As described herein, the lens 606 is configured to provide durable and distortion-free optical clarity through an entire range of vision, ensuring clear peripheral vision of the participant at all angles. The lens 606 is also configured to contour from a generally planar configuration to curvilinear structure. Moreover, the lens 606 is replaceable and thus friction-fit into channels (not shown) of the frame 600. The lens 606 is shorter on the peripheral sides of the frame 600, which provides ventilation openings 610. Ventilation slits 608 and ventilation openings 610 facilitate ventilation of air in order to mitigate fogging. As discussed hereinabove, an anti-fogging coating can also be disposed on the interior surface of the lens 606 to further resist fogging.

The tabs 614 are configured to slide into slots 215 provided along the interior of the base layer 200 of the frontal shell section 202, so that the shield 108 can be secured in relation to the flexible shell 102. As described herein, the forehead stabilizer 106 provides stabilization of the flexible shell 102, so that the eye shield 108 can be retained more securely in connection with the flexible shell 102.

Figure 7A:
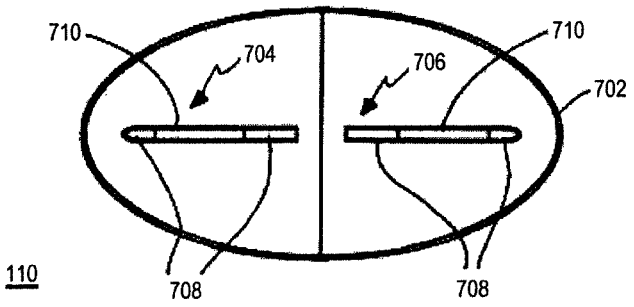
FIGS. 7A-7C illustrate an example chin guard of the fastening system associated with the protective headgear illustrated in FIG. 1.
Figure 7B:
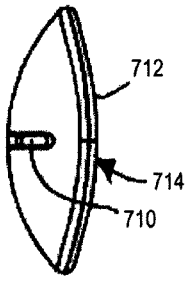
Figure 7C:
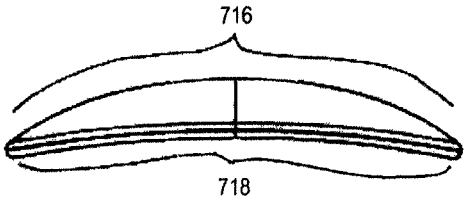

FIG. 7A-7C illustrate an example chin guard 110 of the fastening system associated with the protective headgear 100 illustrated in FIG. 1.

The chin guard 110 generally has a curvilinear shell-shaped structure in order to protect the chin. The outer periphery 702 of the chin guard 110 is generally oval, with curvilinear edges 712, an arcuate top surface 716, bottom edge surface 718, and a recessed interior 714, which serve to contour the chin. The chin guard 110 includes channels 704, 706, which include recessed channel sections 710 and terminal openings 708. The channel sections 704, 706 cooperate with the channel 211 in order to allow the jaw lead to advance or extend about the jaw shell section 290, between and to the shell section 282.

FIGS. 8A-8C illustrate an example lock holder 112 of the fastening system associated with the protective headgear 100 illustrated in FIG. 1.

The lock holder 112 is configured to connect with and retain the lock (FIGS. 9B and 10) in relation to the protective headgear 100. The lock holder 112 generally has a bowtie shape, with peripheral sections 802, 812 connected by recessed center section 822. The left peripheral section 802 of the bowtie includes wall 804 with openings 808, 810, and sloping surface 806 with opening 807. Similarly, the right peripheral section 812 of the bowtie includes wall 814 with openings 818, 820, and sloping surface 816 with opening 817.

The recessed center section 822 receives and secures the lock (FIGS. 9B and 10) using respective tabs of the lock that slide into and engage the openings 810, 820. The tail lead from the shell sections 282 extends along guide channels 824, 826 through the respective openings 808, 818 to the center section 822, so that the lead can be connected to the lock that is disposed in the center section 822.

The openings 807, 817 can be provided to receive rivets that can be used to reinforce securement of the lock holder 112 to the tail section 273. In those embodiments that do not use rivets, the openings 807, 817 can be omitted and the lock holder 112 can be glued to the tail section 273 of the flexible shell 102. Moreover, the rivets can be used alternatively or additionally to gluing the lock holder 112 to the tail section.

The recesses 828 can be provided in the respective sloped surfaces 806, 816, through which the openings 807, 817 can be provided to secure the rivets to the lock holder 122 and the flexible shell 102. While only two openings are shown, there may be more or fewer openings (e.g., four (4) openings) in the recesses 828 to receive rivets (e.g., four (4) rivets).

FIGS. 9A-9C illustrate several views of the assembled form-fitting protective headgear 100 with the integrated fastening system and the detachable eye shield as illustrated in FIG. 1.

As illustrated, a forehead lead 902 extends through channel 210 and channel sections 514 of the stabilizer 106 from the left temporal shell section 282 to the right temporal shell sections 282, and is received in a y-shaped connection recess 316 of the connectors 104. Similarly, a jaw lead 904 extends through channel 211 and channels 704, 706 of the chin guard 110 from the left temporal shell section 282 to the right temporal shell section 282, and is received in the y-shaped connection recess 316 of the connectors 104. Moreover, a tail lead 906 extends through channels 824, 826 of the lock holder 112 and engages the lock 910 in the tail section 273 from the left temporal shell section 282 to the right temporal shell section 282, and is received in the y-shaped connection recess 316 of the connectors 104. As illustrated, the lock 910 is secured to the lock holder 112.

A y-shaped coupler 909 is used to connect the ends of the forehead, jaw, and tail leads 902, 904, and 906, respectively. The Y-shaped coupler 909 is disposed in the connector 104 in the y-shaped connection recess 316 between guide sections 318, 324, and 330.

The straps 602 of the eye shield 108 are received into the eye shield lock 310, and the tabs 614 of the eye shield 108 are received into slots 215 provided along the interior of the frontal shell section 202, so that the shield 108 is secured in relation to the flexible shell 102. The forehead stabilizer 106 provides stabilization of the flexible shell 102, so that the eye shield 108 can be retained more securely in connection with the flexible shell 102.

Figure 10:
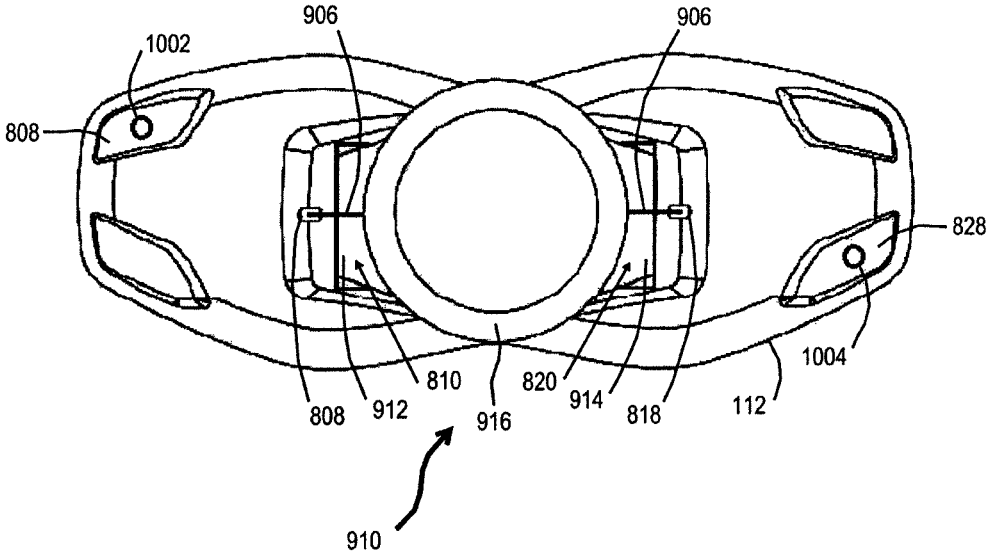
FIG. 10 illustrates the integration of the example lock holder illustrated in FIGS. 8A-8C with the example lock illustrated in FIGS. 9A-9C.

FIG. 10 illustrates the integration of the example lock holder 112 illustrated in FIGS. 8A-8C with the example lock 910 illustrated in FIGS. 9A-9C.

The lock 910 is configured to be received into and secured by the lock holder 112. Specifically, the lock includes tabs 912, 914 that are received into respective openings 810, 820 to secure the lock 910 in the center section 822 of the lock holder 112.

The lock 910 is further configured to connect the tail lead 906 that extends from the left and right connectors 104. The lock 910 wraps the tail lead around a spool (not shown) and can shorten (and lock) the tail lead 906 in a predetermined amount by rotating a wheel 916 in a first direction (e.g., clockwise), such that the forehead and jaw leads 902, 904 can be shortened—each shortened approximately evenly by half of the tail-lead amount—in order to tighten the integrated fastening system of the headgear 100 so that the headgear 100 is disposed tightly around the participant's head.

Similarly, the lock 910 is also configured with a quick-release by rotating the wheel 916 in a second direction (e.g., counterclockwise), which can release the tail lead 906—in order to release the forehead and jaw leads 902, 904— allowing the participant to easily take off the protective headgear 100 from the participant's head. The headgear 100 as integrated with the lock 910 and other elements as described herein provides much improved performance, precision, comfort, durability, as well as fast and convenient operation.

As further illustrated, rivets 1002, 1004 can be inserted through openings 807, 817 in the recesses 828, 828 of the sloped surfaces 806, 816, so that the lock holder 112 is more securely attached to the flexible shell 102. While only rivets 1002, 1004 are shown, more or fewer rivets can be provided through the openings in the recesses 828, such as above or below the shown rivets 1002, 1004.

Thus, a form-fitting protective headgear with an integrated fastening system and a detachable eye shield have been described. Although specific example embodiments have been described, it will be evident that various modifications and changes may be made to these embodiments without departing from the broader spirit and scope of the invention.

Accordingly, the specification and drawings are to be regarded in an illustrative rather than a restrictive sense. The accompanying drawings that form a part hereof, show by way of illustration, and not of limitation, specific embodiments in which the subject matter may be practiced. The embodiments shown are described in sufficient detail to enable those skilled in the art to practice the teachings disclosed herein. Other embodiments may be utilized and derived therefrom, such that structural and logical substitutions and changes may be made without departing from the scope of this application.

The foregoing detailed description, therefore, is not to be taken in a limiting sense, and the scope of various embodiments is defined only by the appended claims, along with the full range of equivalents to which such claims are entitled.

Although specific embodiments have been shown and described herein, it should be appreciated that any arrangement calculated to achieve the same purpose may be substituted for the specific embodiments shown. This application is intended to cover any and all adaptations or variations of various embodiments. Combinations of the above embodiments and other embodiments not specifically described herein, will be apparent to those of skill in the art upon reviewing the above description.

The Abstract is provided to comply with 37 C.F.R. § 1.72(b) and will allow the reader to quickly ascertain the nature of the technical disclosure of this application. It is submitted with the understanding that it will not be used to interpret or limit the scope or meaning of the claims.

In the foregoing detailed description, various features may be grouped together in a single embodiment for the purpose of streamlining the disclosure of this application. This method of disclosure is not to be interpreted as reflecting that the claimed embodiments have more features than are expressly recited in each claim. Rather, as the following claims reflect, inventive subject matter lies in less than all features of a single disclosed embodiment.

Moreover, it is contemplated that the features or components of various embodiments described herein can be combined into different combinations that are not explicitly enumerated in the foregoing detailed description and that such combinations can similarly stand on their own as separate example embodiments that can be claimed.

The invention claimed is:

1. A headgear to provide a protective function to a user, the headgear comprising:

a flexible shell configured to at least partially extend about a head of the user, the flexible shell including at least a frontal shell section, a jaw shell section, a left temporal shell section and a right temporal shell section;

wherein the frontal shell section includes a first central portion, a first strap and a second strap extending from the frontal shell section, the first central portion including a first protective layer and a second protective layer disposed atop the first protective layer;

wherein the jaw shell section includes a second central portion, a third strap and a fourth strap extending from the jaw shell section;

wherein the left temporal shell section is connected to the frontal shell section by the first strap of the frontal shell section and is connected to the jaw shell section by the third strap of the jaw shell section;

wherein the right temporal shell section is connected to the frontal shell section by the second strap of the frontal shell section and is connected to the jaw shell section by the fourth strap of the jaw shell section;

a forehead lead extending through a first channel in the frontal shell section, the forehead lead having a first end and an oppositely disposed second end;

a jaw lead extending through a second channel in the jaw shell section, the jaw lead having a third end and an oppositely disposed fourth end;

a first connector disposed atop the left temporal shell section, the first connector receiving the first end and the third end; and a second connector disposed atop the right temporal shell section, the second connector receiving the second end and the fourth end;

a first coupler disposed in the first connector, the first coupler coupling the first end and the third end; and a second coupler disposed in the second connector, the second coupler coupling the second end and the fourth end.

2. The headgear of claim 1, wherein the first central portion includes at least one opening through the first central portion.

3. The headgear of claim 1, wherein the first protective layer has a trapezoid shape.

4. The headgear of claim 3, wherein the trapezoid shape has bowed top and bottom bases.

5. The headgear of claim 1, wherein the second protective layer has a bowtie shape, the bowtie shape including a first section, a second section, and a middle section connecting the first section and the second section.

6. The headgear of claim 5, wherein an opening through the second protective layer is along the middle section and separates the first section and the second section.

7. The headgear of claim 1, wherein the second protective layer includes two sections disposed atop the first protective layer.

8. The headgear of claim 7, wherein an opening through the second protective layer separates the two sections disposed atop the first protective layer.

9. The headgear of claim 1, wherein at least one of the first strap and the second strap of the frontal shell section includes two or more strap sections.

10. The headgear of claim 9, wherein the strap sections have sloping walls that form a v-shaped recess between the strap sections.

11. The headgear of claim 9, wherein at least one strap section of the two or more strap sections includes an opening through the strap.

12. The headgear of claim 1, further comprising:

a tail section comprising a lock; and a tail lead having a fifth end and an oppositely disposed sixth end, the tail lead being connected to the lock, wherein the first connector additionally receives the fifth end, and the second connector additionally receives the sixth end.

13. The headgear of claim 12, wherein the first coupler additionally couples the fifth end, and the second coupler additionally couples the sixth end.

14. The headgear of claim 13, wherein the lock is configured to be rotated in a first direction that tensions the tail lead, the tail lead in turn tensioning the forehead lead and the jaw lead via the first coupler and the second coupler.

15. The headgear of claim 13, wherein the lock is configured to be rotated in a second direction that releases tension from the tail lead, the tail lead in turn releases tension from the forehead lead and the jaw lead via the first coupler and the second coupler, respectively.

16. The headgear of claim 1, further comprising:

an eye shield having a first strap and a second strap;

wherein the first connector includes a first strap lock, the first strap lock receiving and securing the first strap of the eye shield; and wherein the second connector includes a second strap lock, the second strap lock receiving and securing the second strap of the eye shield.

17. The headgear of claim 16, wherein:

the first strap of the eye shield includes a first set of sloped projections;

the second strap of the eye shield includes a second set of sloped projections;

the first strap lock includes a third set of reciprocal sloped projections, the third set of projections engaging the first set of projections; and the second strap lock includes a fourth set of reciprocal sloped projections, the fourth set of projections engaging the second set of projections.

18. The headgear of claim 16, wherein the first strap lock includes a first opening configured to receive therein the first strap of the eye shield, and the second strap lock includes a second opening configured to receive therein the second strap of the eye shield.

* * * * *